US008534192B2

(12) United States Patent
Hashimoto et al.

(10) Patent No.: US 8,534,192 B2
(45) Date of Patent: Sep. 17, 2013

(54) PRINTING PLATE CYLINDER, PRINTING APPARATUS, AND METHOD FOR PRODUCING PRINTING PLATE CYLINDER

(75) Inventors: Hiroaki Hashimoto, Sunto-gun (JP); Kenji Kumasaki, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 319 days.

(21) Appl. No.: 12/735,890

(22) PCT Filed: Feb. 26, 2009

(86) PCT No.: PCT/JP2009/053520

§ 371 (c)(1),
(2), (4) Date: Aug. 24, 2010

(87) PCT Pub. No.: WO2009/107706

PCT Pub. Date: Sep. 3, 2009

(65) Prior Publication Data

US 2010/0319555 A1 Dec. 23, 2010

(30) Foreign Application Priority Data

| | | |
|---|---|---|
| Feb. 28, 2008 | (JP) | 2008-047583 |
| Mar. 28, 2008 | (JP) | 2008-088332 |
| Nov. 26, 2008 | (JP) | 2008-300831 |
| Feb. 2, 2009 | (JP) | 2009-021936 |

(51) Int. Cl.

| | |
|---|---|
| ***B41F 13/00*** | (2006.01) |
| ***B41F 7/02*** | (2006.01) |
| ***B41F 13/22*** | (2006.01) |
| ***B41F 30/00*** | (2006.01) |
| ***B41N 7/00*** | (2006.01) |

(52) U.S. Cl.
USPC ..... 101/375; 101/382.1

(58) Field of Classification Search
USPC ..... 101/375, 389.1, 382.1, 368
See application file for complete search history.

(56) References Cited

U.S. PATENT DOCUMENTS 5,168,808 A * 12/1992 Prem ..... 101/375
5,788,382 A * 8/1998 Egbert et al. ..... 400/118.3

(Continued)

FOREIGN PATENT DOCUMENTS

DE 569950 C 2/1933
DE 20 2004 004 375 U1 10/2004

(Continued)

OTHER PUBLICATIONS

Notice of Allowance mailed Jul. 3, 2012, issued for the Japanese Patent Application No. 2009-021936 and English translation thereof.

(Continued)

*Primary Examiner* — Daniel J Colilla
*Assistant Examiner* — Leo T Hinze
(74) *Attorney, Agent, or Firm* — Edwards Wildman Palmer LLP

(57) ABSTRACT

Provided is a printing plate cylinder to which a sleeve printing plate is detachably attached. In the printing plate cylinder, weight reduction and radiation performance can be improved, and generation of rust can be suppressed. The printing plate cylinder (1) includes a shaft portion (3) rotatable about a central axis (O), a tubular portion (5) formed cylindrically, arranged coaxially with the shaft portion (3), and arranged at a distance from an outer circumferential surface (3*a*) of the shaft portion (3), and a rib (7) fixed integrally to the outer circumferential surface (3*a*) of the shaft portion (3) and an inner circumferential surface (5*b*) of the tubular portion (5) and connecting the shaft portion (3) and the tubular portion (5). An air supply channel (31) is formed so as to penetrate from the outer surface of the rib (7) exposed to the outside to the outer circumferential surface (5*a*) of the tubular portion (5).

23 Claims, 25 Drawing Sheets

(56) References Cited

U.S. PATENT DOCUMENTS

| | | | | |
|---|---|---|---|---|
| 5,894,796 | A * | 4/1999 | Gelinas | 101/219 |
| 6,250,221 | B1 * | 6/2001 | Tice | 101/246 |
| 6,467,409 | B2 * | 10/2002 | Busshoff | 101/375 |
| 7,124,685 | B2 * | 10/2006 | Re et al. | 101/375 |
| 2002/0178954 | A1 | 12/2002 | Hayashi et al. | |
| 2007/0144381 | A1 | 6/2007 | Lorig et al. | |

FOREIGN PATENT DOCUMENTS

| | | | |
|---|---|---|---|
| GB | 1141198 | A | 1/1969 |
| JP | 48-006570 | U | 2/1973 |
| JP | 53-061415 | | 6/1978 |
| JP | 57-121966 | U | 7/1982 |
| JP | 04-359765 | A | 12/1992 |
| JP | 05-193097 | A | 8/1993 |
| JP | 05-301336 | A | 11/1993 |
| JP | 06-039208 | U | 5/1994 |
| JP | 07-186360 | A | 7/1995 |
| JP | 09-001774 | A | 1/1997 |
| JP | 09-099663 | A | 4/1997 |
| JP | 10-193557 | A | 7/1998 |
| JP | 2002-347214 | A | 12/2002 |
| JP | 2007-044987 | A | 2/2007 |
| JP | 2007-118253 | A | 5/2007 |
| JP | 2009241298 | A | 10/2009 |

OTHER PUBLICATIONS

Office Action mailed Jan. 24, 2012, issued for the Japanese patent application No. 2009-021936 and English translation thereof.

Office Action mailed Jan. 24, 2012, issued for the Japanese patent application No. 2008-088332 and English translation thereof.

Supplementary European Search Report dated May 25, 2011, issued for the corresponding European patent application No. 09715608.7.

International Search Report dated Apr. 7, 2009, issued in PCT/JP2009/053520.

Japanese Office Action mailed Dec. 4, 2012, issued for the Japanese Patent Application No. 2009-266673 and English translation thereof.

Japanese Office Action mailed Dec. 4, 2012, issued for the Japanese Patent Application No. 2012-171435 and English translation thereof.

Office Action mailed Jun. 4, 2013, issued for the Japanese patent application No. 2012-171435 and English translation thereof.

* cited by examiner

PRINTING PLATE CYLINDER, PRINTING APPARATUS, AND METHOD FOR PRODUCING PRINTING PLATE CYLINDER

TECHNICAL FIELD

The present invention relates to a printing plate cylinder to which a sleeve-shaped printing plate is detachably attached, a printing apparatus including the same, and a method for producing a printing plate cylinder. The present invention also relates to a printing plate cylinder including a cooling mechanism for keeping good ink viscosity at the time of printing, its cooling member, and a printing apparatus for a can. The present invention also relates to a printing plate cylinder which is supported by a rotary shaft of a printing apparatus and on a cylindrical surface of which a printing plate having an image pattern is mounted and used, and an offset printing apparatus including the printing plate cylinder.

The present application claims priority on Japanese Patent Application No. 2008-047583, filed Feb. 28, 2008, Japanese Patent Application No. 2008-088332, filed Mar. 28, 2008, Japanese Patent Application No. 2008-300831, filed Nov. 26, 2008, and Japanese Patent Application No. 2009-021936, filed Feb. 2, 2009, the contents of which are incorporated herein by reference.

BACKGROUND ART

A sleeve-shaped printing plate to be used for various kinds of printing, as in, for example, Patent Document 1, is fitted through a printing plate cylinder, and thereby fixed so as to come into close contact with the outer circumferential surface of the printing plate cylinder. A conventional printing plate cylinder is formed substantially in a cylindrical shape which has a hollow air chamber, and is constructed to form an air supply hole which penetrates into the air chamber from an axial end surface thereof, and an air outlet hole which penetrates into the air chamber from an outer circumferential surface thereof.

In this printing plate cylinder, when air is introduced into the air chamber from the air supply hole to raise the pressure of the air chamber in a state where the printing plate is fixed to the outer circumferential surface of the printing plate cylinder so as to block the air outlet, high-pressure air is blown off through the air outlet with this pressure rise. Accordingly, when the printing plate is attached to and detached from the printing plate cylinder, since the printing plate can be inflated radially outward by the high-pressure air which is blown off through the air outlet, the printing plate can be easily attached and detached.

Additionally, the following one is conventionally known as a common problem related to the printing quality in a printing apparatus under operation. That is, in the cylindrical printing plate cylinder having the printing plate, to which a printing design (image portion) is given, on the outer circumferential surface thereof, at the time of printing, the surface temperature of the printing plate is gradually raised due to frictional heat with a blanket in contact with the printing plate or the conduction of heat from a driving shaft side which supports a rotating shaft portion, and accordingly ink temperature rises, and ink viscosity decreases. As a result, ink spread, color tones or the like vary, and printing quality is reduced. Additionally, in a waterless planographic plate, it is known that such a temperature rise of the printing plate cylinder promotes deterioration of the printing plate.

In order to prevent such a phenomenon, for example, in a printing apparatus disclosed in Patent Document 2, cold air is forcibly applied to a shaft portion of a rotating printing plate cylinder, and the temperature of the printing plate cylinder and the printing plate is lowered for cooling.

Meanwhile, in recent years, there is known a CTS (Computer To plate on Sleeve) technique of using a cylindrical sleeve member on the outer circumferential surface of which a printing plate is installed, directly laser-machining the printing plate to form an image portion, and then allowing attachment and detachment of each sleeve member to/from the printing plate cylinder. According to this CTS technique, positioning of the printing plate can be easily performed with high accuracy, and the operation process for forming an image portion on the printing plate and replacement (attachment and detachment) of the printing plate can be simply and easily performed. Thus, productivity is remarkably increased.

Generally, a two-piece can to be used as a container, such as for soft drinks, is composed of a can lid, and a can barrel which is a cylindrical body. The can barrel is subjected to DI (deep-drawing, ironing) work and cleaning, and then printing is performed on the outer surface of the can barrel. When a cylindrical object, such as the can barrel, is printed, for example, the offset printing apparatus using offset printing as shown in Patent Document 1 is used.

Such an offset printing apparatus includes a plurality of printing plate cylinders which forms a substantially columnar shape or a substantially cylindrical shape, and has a printing plate composed of a relief printing plate or the like on the cylindrical surface, and a blanket cylinder which rotates in synchronization with these printing plate cylinders, and has a blanket made of rubber disposed on the outer circumferential surface, and the printing plates of the printing plate cylinders and the blanket of the blanket cylinder come into contact with each other. Ink is applied to the printing plate of each printing plate cylinder, this ink is transferred to the blanket, and this blanket comes into contact with the outer circumferential surface of the can barrel so that printing is performed on the outer circumferential surface of the can barrel.

In such a printing plate cylinder, since it is necessary to arrange the printing plate with high accuracy on the cylindrical surface, the stability of the external diameter is required. Additionally, since the printing plate cylinder is attached to and detached from a rotary shaft of the printing apparatus, the accuracy of the shape of the portion in which the rotary shaft is fitted is required. For this reason, generally, the conventional printing plate cylinder has relatively high rigidity, and is constituted of carbon steel having excellent workability.

[Patent Document 1] Japanese Patent Unexamined Publication No. 2007-44987

[Patent Document 2] Japanese Patent Unexamined Publication No. 2002-347214

DISCLOSURE OF INVENTION

Problems to be Solved by the Invention

Since the above conventional printing plate cylinder is constructed to have a large air chamber, there is a problem in that the weight of the printing plate cylinder becomes heavy.

Additionally, since heat radiation at the time of printing is low in this printing plate cylinder, the viscosity of ink is not stabilized, and it becomes difficult to achieve a constant printing state. As a result, there is also a problem in that unevenness occurs in printing.

Moreover, after the printing plate is inflated by high-pressure air and mounted on the printing plate cylinder, there is also a problem in which dew is apt to be formed in the air chamber or the air outlet hole of the printing plate cylinder.

That is, in a state wherein the printing plate is inflated by high-pressure air and mounted on the printing plate cylinder, the air chamber is held at high pressure. However, when piping for air supply is removed from the air supply hole after the mounting of the printing plate, the pressure in the air chamber drops rapidly, and consequently, dew is formed in the air chamber or the air outlet hole of the printing plate cylinder. Here, in a case where the printing plate cylinder is made of a raw material which may rust like iron, formation of dew becomes a factor of generation of rust. When rust is generated in the air chamber or the air outlet hole, there is a possibility that the attachability and the detachability of the printing plate to and from the printing plate cylinder may deteriorate.

Additionally, in the printing apparatus of Patent Document 2, since it is necessary to provide a forced air-cooling device which generates cold air for cooling the printing plate cylinder, or to provide an air-cooling duct for blowing off the cold air generated by the forced air-cooling device to the shaft portion of the printing plate cylinder, there is a problem in that the configuration of the apparatus becomes complicated, and the facility cost, the operation cost, and the maintenance cost are increased.

Meanwhile, in the printing plate cylinder made of carbon steel, rust may be generated at the time of use. Particularly, since it becomes impossible to arrange the printing plate with high accuracy when rust is generated on the cylindrical surface, in the conventional printing plate cylinder made of carbon steel, a plating treatment is performed on the cylindrical surface.

For this reason, especially, in a large-sized printing plate cylinder, it is required that rust is not generated even if the plating treatment is omitted.

Additionally, the weight of a printing plate cylinder made of carbon steel becomes comparatively heavy. For this reason, in a case where printing plate cylinders are frequently replaced, or in a case where the rigidity of a rotary shaft of a printing apparatus is low, the weight reduction of the printing plate cylinder is required.

Additionally, since carbon steel has good heat conduction, the heat generated from a driving unit of a printing apparatus is transmitted through a rotary shaft, and the temperature of the cylindrical surface of a printing plate cylinder is apt to rise. Then, there is a possibility that the temperature of the printing plate disposed on the cylindrical surface may also rise, the viscosity of ink adhering to this printing plate may change in a printing process, and the printing quality may deteriorate significantly. For this reason, especially in a case where there is the need of performing a prolonged printing job, the printing plate cylinder which can suppress transmission of heat is required.

As such, characteristics required for the printing plate cylinder are various according to printing conditions (printing states), and these requirements cannot be satisfied in the conventional printing plate cylinder made of carbon steel.

The present invention was made in view of such a situation, and an object thereof is to provide a printing plate cylinder, a printing apparatus including the same, and a method for producing the printing plate cylinder, which can reduce weight and improve heat radiation, and can also suppress generation of rust, a printing apparatus including the printing plate cylinder, and a method for producing the printing plate cylinder.

Additionally, another object of the present invention is to provide a printing plate cylinder, its cooling member, and a printing apparatus for a can which can cool the printing plate cylinder with a simple configuration, suppress the rise of the ink temperature of the printing plate to stabilize ink viscosity, and secure accuracy of ink spread, color tones, etc. even at the time of continuous operation.

Moreover, still another object of the present invention is to provide a printing plate cylinder and an offset printing apparatus including this printing plate cylinder, capable of satisfying various characteristics which are required according to printing conditions (printing states).

Means for Solving the Problems

In order to solve the above problems, the printing plate cylinder related to the present invention is a printing plate cylinder detachably mounted with a sleeve printing plate which forms a cylindrical shape. The printing plate cylinder includes a shaft portion rotatable about a central axis, a tubular portion formed cylindrically, arranged coaxially with the shaft portion, and arranged at a distance from an outer circumferential surface of the shaft portion, and a rib fixed integrally to the outer circumferential surface of the shaft portion and an inner circumferential surface of the tubular portion and connecting the shaft portion and the tubular portion. The tubular portion is formed with an air outlet hole opened to an outer circumferential surface of the tubular portion, the rib is formed with an air supply passage which communicates with the air outlet hole, and the sleeve printing plate is mounted with an increased diameter by blown off air from the air outlet hole through the air supply passage.

In addition, an air supply port for introducing air into the air supply passage formed in the rib can be formed at arbitrary positions, such as positions where the sleeve printing plate is not disposed among the outer surface of the rib, the outer circumferential surface and axial end surface of the shaft portion, the inner circumferential surface of the tubular portion, and the outer circumferential surface of the tubular portion.

In the printing plate cylinder of this configuration, since the sleeve printing plate inflates radially outward when the sleeve printing plate is mounted, and high-pressure air is blown off through the air outlet hole, the sleeve printing plate can be smoothly mounted. In addition, in this configuration, even if high-pressure air is blown off through the air outlet hole when the sleeve printing plate is removed, it is similarly possible to smoothly remove the sleeve printing plate.

According to this printing plate cylinder, since the shaft portion and the tubular portion are connected together by the rib, it is possible to make the diameter of the shaft portion small or to make the thickness of the tubular portion thin, and it is possible to easily reduce the weight of the printing plate cylinder.

Additionally, since the gap region between the shaft portion and the tubular portion can be opened to the outside from both axial ends of the printing plate cylinder by connecting the shaft portion and the tubular portion together by the rib, it is possible to efficiently cool the printing plate cylinder, for example, by make cooling air flow to this gap region at the time of printing. That is, the heat radiation at the time of printing can be improved, and the viscosity of ink can be stabilized to prevent occurrence of printing unevenness.

Moreover, since a large air chamber is not provided in the printing plate cylinder unlike the conventional printing plate cylinder, and the air supply passage with a small volume is simply formed, even if the pressure of the air supply passage drops sharply, formation of dew can be suppressed to the minimum. As a result, generation of rust on the printing plate cylinder can be suppressed, and deterioration of the attachability and detachability of the sleeve printing plate to the printing plate cylinder can be prevented.

In the above printing plate cylinder, preferably, the tubular portion includes an inside tubular portion formed integrally with the rib, and an outside tubular portion mounted on an outer circumferential surface of the inside tubular portion.

Additionally, in the above printing plate cylinder, preferably, the air outlet hole is formed so as to penetrate in the thickness direction of the outside tubular portion, a plurality of the air outlet holes is arrayed in the circumferential direction of the outside tubular portion, and at least one of the outer circumferential surface of the inside tubular portion and the inner circumferential surface of the outside tubular portion is formed with an air circulation groove which is formed so as to extend in the circumferential direction and communicates with the air supply passage and the plurality of air outlet holes.

According to the printing plate cylinder of this configuration, the high-pressure air introduced into the air supply passage can be evenly delivered in the circumferential direction by the air circulation groove. Therefore, even if the number of the air supply passages is fewer than the number of the air outlet holes, it is possible to uniformly blow off the high-pressure air introduced into the air supply passage through each air outlet hole.

Additionally, in the printing plate cylinder of this configuration, it is possible to easily form the air supply passage, the air circulation groove, and the air outlet hole. Therefore, the air supply channel through which air is guided from the air supply port to the air outlet hole can be simply formed. For example, the air supply passage can be easily formed simply by forming an axial hole which extends in the axial direction from the axial end surface of the rib, and forming a radial hole which extends radially inward from the outer circumferential surface of the inside tubular portion so as to communicate with the axial hole.

Moreover, in the above printing plate cylinder, preferably, the plurality of air outlet holes and the air circulation groove may be plurally arranged even in the axis direction.

When the sleeve printing plate is attached to and detached from the printing plate cylinder, the sleeve printing plate is moved in the axial direction with respect to the printing plate cylinder. However, by adopting the above-described configuration, high-pressure air can be blown off through a plurality of axial places of the outer circumferential surface of the outside tubular portion. Therefore, in the process of detaching and attaching the sleeve printing plate, the inflation state of the sleeve printing plate by the high-pressure air can be maintained long, and it is possible to smoothly attach and detach the sleeve printing plate.

Additionally, in the above printing plate cylinder, preferably, a plurality of the ribs and a plurality of the air supply passages formed in the ribs are formed so as to shift from each other in the circumferential direction, and the respective air supply passages communicate individually with the plurality of air circulation grooves arrayed in the direction of the axis.

In this configuration, supply of high-pressure air can be individually controlled with respect to the plurality of air outlet holes formed in a plurality of axial places. Therefore, it is possible to blow off high-pressure air only through the air outlet hole covered with the sleeve printing plate. Accordingly, it is possible to prevent high-pressure air from being blown off wastefully to efficiently attach and detach the sleeve printing plate.

Moreover, in the above printing plate cylinder, the inside tubular portion and the outside tubular portion may be formed from different materials.

For example, the inside tubular portion may be formed from a material having good workability, and the outside tubular portion may be formed from a material having rigidity and corrosion resistance. As a specific example of this combination, the inside tubular portion may be formed from carbon steel for a mechanical structure, and the outside tubular portion may be formed from stainless steel. In this case, forming work of the aforementioned air circulation groove or air outlet hole can be easily performed on the inside tubular portion or the rib formed integrally with the inside tubular portion. Additionally, the outside tubular portion can be prevented from deforming at the time of printing, or from corroding due to ink or the like.

Additionally, the printing apparatus of the present invention is constructed using the above printing plate cylinder.

According to this printing apparatus, the weight of the printing apparatus can be reduced by providing the lightweight printing plate cylinder. Additionally, since occurrence of printing unevenness can be suppressed at the time of printing, the yield of cans can be improved.

Moreover, since generation of rust in the printing plate cylinder can also be suppressed, it is possible to use the same printing plate cylinder over a long period of time without replacement, and it is consequently possible to reduce the running cost of the printing apparatus.

Also, the method for producing a printing plate cylinder related to the present invention is a method for producing the printing plate cylinder constructed so that the tubular portion includes the inside tubular portion and the outside tubular portion. The method includes hollowing a columnar member used as a material of the shaft portion, the rib, and the inside tubular portion in the direction of the axis, thereby producing a core member in which the shaft portion, the rib, and the inside tubular portion are integrally shaped, and then mounting the core member in the outside tubular portion.

According to the method for producing a printing plate cylinder of the present invention, it is possible to obtain a core member in which the shaft portion, the rib, and the inside tubular portion which extends in the axial direction of the columnar member are integrally shaped. By mounting the core member in the outside tubular portion after the completion of production of the core member, it is possible to prevent deviation from occurring in the external diameter of the inside tubular portion with respect to the internal diameter of the outside tubular portion. That is, it is possible to shape the inside tubular portion with high accuracy.

In the method for producing a printing plate cylinder, in a case where shaping of the shaft portion, the rib, and the inside tubular portion is performed by machining, such as wire cutting work or cutting work, the shapes of the shaft portion, the rib, and the inside tubular portion can be finished with higher accuracy.

Additionally, the present invention suggests the following means in order to achieve the above objects. That is, the present invention provides a printing plate cylinder including a shaft portion rotating about a central axis, and a tubular portion spaced apart from the outside of the shaft portion to form a region and disposed coaxially and integrally with the shaft portion. Fins are disposed to generate an air stream in the region with the rotation.

According to the printing plate cylinder related to the present invention, fins generate an air stream in the region between the shaft portion and the tubular portion with this rotation of the printing plate cylinder at the time of printing. Therefore, the printing plate cylinder is cooled by this air stream, and temperature can be prevented from rising excessively even at the time of continuous operation. Accordingly, the temperature rise of ink to be applied to the outer circumferential surface of the printing plate cylinder is suppressed, ink viscosity is stabilized, and good accuracy of ink spread, color tones or the like is maintained.

Additionally, in the printing plate cylinder of the present invention, the fins may extend to incline with respect to the central axis.

According to the printing plate cylinder of the present invention, the fins extend to incline so as to be twisted with respect to the central axis of the printing plate cylinder, and the direction of the central axis and the extension direction of the fins are set so as not to be parallel to each other. The shape of the fins is formed, for example, spirally about the central axis. By such fins, when the printing plate cylinder has rotated at the time of printing, the fins are adapted to reliably generate an air stream in the direction of the central axis, and the generated air stream exchanges heat with the surfaces or the like which forms the region, thereby suppressing the temperature rise of the printing plate cylinder.

Additionally, in the printing plate cylinder of the present invention, a cooling member attachable to and detachable from the end in the direction of the central axis may be provided, and the cooling member may include the fins, and rotate integrally with the shaft portion to generate an air stream in the region.

Additionally, the present invention provides a cooling member to be mounted on a printing plate cylinder including a shaft portion rotating about a central axis, and a tubular portion spaced apart from the outside of the shaft portion to form a region and disposed coaxially and integrally with the shaft portion. The cooling member includes fins which generate an air stream in the region with the rotation, and is made attachable to and detachable from the end of the printing plate cylinder in the direction of the central axis.

According to the printing plate cylinder and its cooling member of the present invention, fins are formed on the cooling member attachable to and detachable from the end in the direction of the central axis. Thus, when the printing plate cylinder has rotated, the shaft portion and the cooling member rotate integrally, and the fins of the cooling member generate an air stream in the region between the shaft portion and the tubular portion. Accordingly, for example, in a case where a printing apparatus is provided with a plurality of printing plate cylinders, the number or shape of the fins of the cooling member can be set in accordance with a desired cooling temperature of each printing plate cylinder, or the cooling member can be easily installed by post-installation, and it is possible to cope with various demands of cooling of the printing plate cylinders flexibly.

Additionally, in the printing plate cylinder of the present invention, the fins may be erected with at least one of the outer circumferential surface of the shaft portion or the inner circumferential surface of the tubular portion on base ends.

According to the printing plate cylinder of the present invention, since an air stream is generated as the erected fins reliably catch and sweep away the air in the region between the shaft portion and the tubular portion by rotation at the time of printing, the printing plate cylinder is effectively cooled.

Additionally, in the printing plate cylinder of the present invention, ribs may be provided to connect the outer circumferential surface of the shaft portion and the inner circumferential surface of the tubular portion together, and the ribs may be the fins.

According to the printing plate cylinder of the present invention, the ribs which connect the outer circumferential surface of the shaft portion and the inner circumferential surface of the tubular portion are used as the fins for cooling. Thus, the effect of cooling the printing plate cylinder with a simple configuration is obtained without increasing the number of components compared to the conventional technique.

Additionally, in the printing plate cylinder of the present invention, a driving shaft which is arranged coaxially with the shaft portion to rotatably support the shaft portion may be provided, and the air stream may be set so as to flow from the tip side of the driving shaft in the direction of the central axis towards the base end side of the driving shaft.

According to the printing plate cylinder of the present invention, the air stream to be generated by the fins is set so as to flow from the tip side of the driving shaft in the direction of the central axis towards the base end side of the driving shaft. Thus, cooled ambient air is easily drawn into the region, and the conduction of heat to the printing plate cylinder from the driving shaft which generates heat at the time of operation is suppressed, thereby improving cooling efficiency.

Additionally, the present invention is a printing apparatus performing printing on a can using a printing plate cylinder, and the aforementioned printing plate cylinder is used.

According to the printing apparatus for a can related to the present invention, it is possible to improve the accuracy and productivity of printing to cope with the various demands of printing of cans flexibly.

Moreover, in order to solve the aforementioned problems, the printing plate cylinder related to the present invention is a printing plate cylinder having a cylindrical surface extending along an axis and mounted with a printing plate having an image pattern on the cylindrical surface. The printing plate cylinder includes a core member which has a fitting hole into which a rotary shaft of a printing apparatus is fitted, and a sleeve member arranged on the outer circumferential side of the core member and having the cylindrical surface. The core member and the sleeve member are made of different materials.

According to the printing plate cylinder of this configuration, the core member into which the rotary shaft is fitted, and the sleeve member on which the printing plate is mounted are separately formed, and the core member and the sleeve member are made of mutually different materials. Thus, it is possible to appropriately select the materials of the core member and the sleeve member according to required characteristics. For example, by forming the core member from a material having good workability, it is possible to shape a fitting hole with high dimensional accuracy, and attachment and detachment of the printing plate cylinder and the rotary shaft can be smoothly performed. Additionally, by forming the sleeve member in which the printing plate is disposed from a material in which rust is hardly generated, it becomes unnecessary to perform plating treatment. Additionally, by forming either the core member or the sleeve member from a material whose heat conductivity is lower than carbon steel, the heat generated from a driving unit of a printing apparatus is hardly transferred to the printing plate, and it is possible to stably perform printing for a long period of time.

Thus, it is possible to construct a suitable printing plate cylinder having the required characteristics.

Here, one or more interlayers may be formed between the sleeve member and the core member.

In this case, by selecting the material of the interlayer provided between the sleeve member and the core member, it is possible to add further characteristics to the printing plate cylinder. For example, by forming the interlayer from a material whose heat conductivity is lower than carbon steel, conduction of heat generated from a driving unit of a printing apparatus can be suppressed, without changing the material of the core member or the sleeve member.

Additionally, the core member may be made of carbon steel, and the sleeve member may be made of stainless steel.

In this case, the core member is made of carbon steel having excellent workability. Thus, the fitting hole into which the rotary shaft is fitted can be shaped with high dimensional accuracy, and it is possible to smoothly perform attachment and detachment of the printing plate cylinder. Additionally, since the sleeve member is made of stainless steel, generation of rust can be suppressed, and it is not necessary to perform plating treatment on the cylindrical surface. Hence, the lifespan of the printing plate cylinder can be extended.

Additionally, the core member may be made of stainless steel, and the sleeve member may be made of a resin material.

In this case, since the core member is made of stainless steel, it is possible to suppress generation of rust in the core member. Additionally, since the sleeve member is made of a resin material, it is possible to reduce the weight of the printing plate cylinder, and generation of rust on the cylindrical surface can be suppressed. Moreover, since the resin material has low heat conductivity, conduction of heat generated from a driving unit of a printing apparatus can be suppressed.

Additionally, the core member may be made of a resin material, and the sleeve member may be made of stainless steel.

In this case, since the core member is made of a resin material, it is possible to reduce the weight of the printing plate cylinder. Additionally, conduction of heat generated from a driving unit of a printing apparatus can be suppressed.

Additionally, since the sleeve member is made of stainless steel, it is possible to suppress generation of rust, and plating treatment becomes unnecessary. Moreover, since the sleeve member made of stainless steel having high rigidity is arranged on the outer circumferential side, even if the core member made of a resin material tends to deform due to thermal expansion, the deformation is suppressed by the sleeve member. Thus, the shape stability of the printing plate cylinder can be secured.

Additionally, the core member may be made of carbon steel, the sleeve member may be made of stainless steel, and an interlayer made of a resin material may be formed between the core member and the sleeve member.

In this case, since the core member is made of carbon steel having good workability, the fitting hole into which the rotary shaft is fitted can be shaped with high dimensional accuracy. Additionally, since the sleeve member is made of stainless steel, generation of rust can be suppressed. Moreover, since the interlayer made of a resin material is formed between the core member and the sleeve member, conduction of heat generated from a driving unit of a printing apparatus can be suppressed.

The offset printing apparatus related to the present invention includes the aforementioned printing plate cylinder, and a rotary shaft which rotatably supports the printing plate cylinder about the axis.

According to the offset printing apparatus of this configuration, printing can be stably performed by using the printing plate cylinder with characteristics according to printing conditions (printing states).

Effects of the Invention

According to the present invention, the weight of the printing plate cylinder can be reduced, and occurrence of printing unevenness at the time of printing can be prevented. Additionally, formation of dew can be suppressed to the minimum, and deterioration of attachability and detachability of the sleeve printing plate to the printing plate cylinder can also be prevented.

Additionally, according to the printing plate cylinder, its cooling member, and the printing apparatus for a can related to the present invention, the printing plate cylinder can be cooled with a simple configuration, the rise of the ink temperature of the printing plate can be suppressed to stabilize ink viscosity, and accuracy of ink spread, color tones or the like can be secured even at the time of continuous operation. Accordingly, it is possible to improve the accuracy and productivity of printing to cope with various demands of printing flexibly.

Moreover, according to the present invention, it is possible to provide the printing plate cylinder and the offset printing apparatus including this printing plate cylinder, capable of satisfying various characteristics which are required according to printing conditions (printing states).

EXPLANATION OF REFERENCE

| | |
|---|---|
| 1, 71, 81: | PRINTING PLATE CYLINDER |
| 3: | SHAFT PORTION |
| 3a: | OUTER CIRCUMFERENTIAL SURFACE |
| 5: | TUBULAR PORTION |
| 5a: | OUTER CIRCUMFERENTIAL SURFACE |
| 5b: | INNER CIRCUMFERENTIAL SURFACE |
| 7: | RIB |
| 15: | INSIDE TUBULAR PORTION |
| 15a: | OUTER CIRCUMFERENTIAL SURFACE |
| 17: | OUTSIDE TUBULAR PORTION |
| 17b: | INNER CIRCUMFERENTIAL SURFACE |
| 31, 73, 83A, 83B: | AIR SUPPLY CHANNEL |
| 33, 75A TO 75C, 85A, 85B: | AIR CIRCULATION GROOVE |
| 35, 77, 87, 88: | AIR SUPPLY PASSAGE |
| 37, 79, 89: | AIR OUTLET HOLE |
| O: | CENTRAL AXIS |
| P: | SLEEVE PRINTING PLATE |
| 1001: | SHAFT PORTION |
| 1002: | TUBULAR PORTION |
| 1003, 1023: | RIB |
| 1004, 1014, 1024, 1034: | FIN |
| 1010, 1020, 1030, 1040: | PRINTING PLATE CYLINDER |
| 1011: | DRIVING SHAFT |
| 1041: | COOLING MEMBER |
| 1050: | PRINTING APPARATUS FOR CAN |
| C: | CENTRAL AXIS |
| S: | REGION BETWEEN SHAFT PORTION AND TUBULAR PORTION |
| 2006: | ROTARY SHAFT |
| 2040, 2140, 2240, 2340: | PRINTING PLATE CYLINDER |
| 2050, 2150, 2250, 2350: | CORE MEMBER |
| 2051, 2151, 2251, 2351: | FITTING HOLE |
| 2060, 2160, 2260, 2360: | SLEEVE MEMBER |
| 2000A: | OFFSET PRINTING APPARATUS |

BEST MODE FOR CARRYING OUT THE INVENTION

Figure 1:
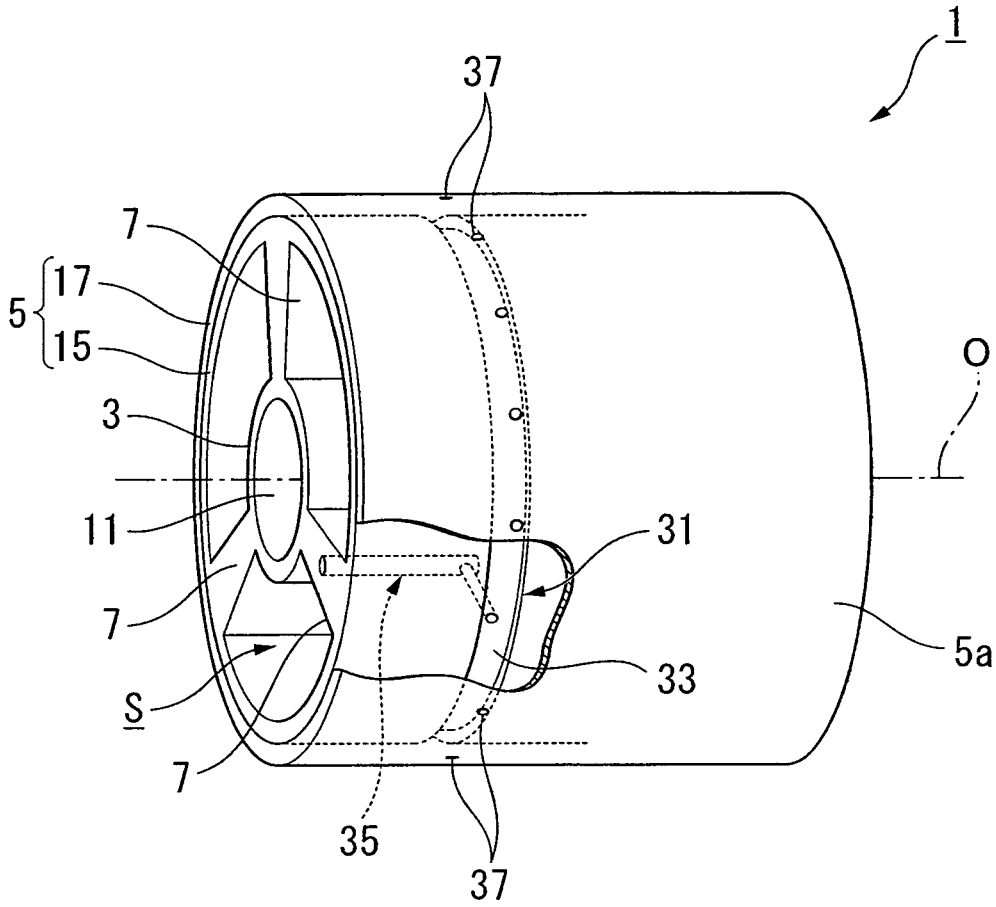
FIG. 1 is a schematic perspective view showing a printing plate cylinder related to a first embodiment of the present invention.
Figure 2:
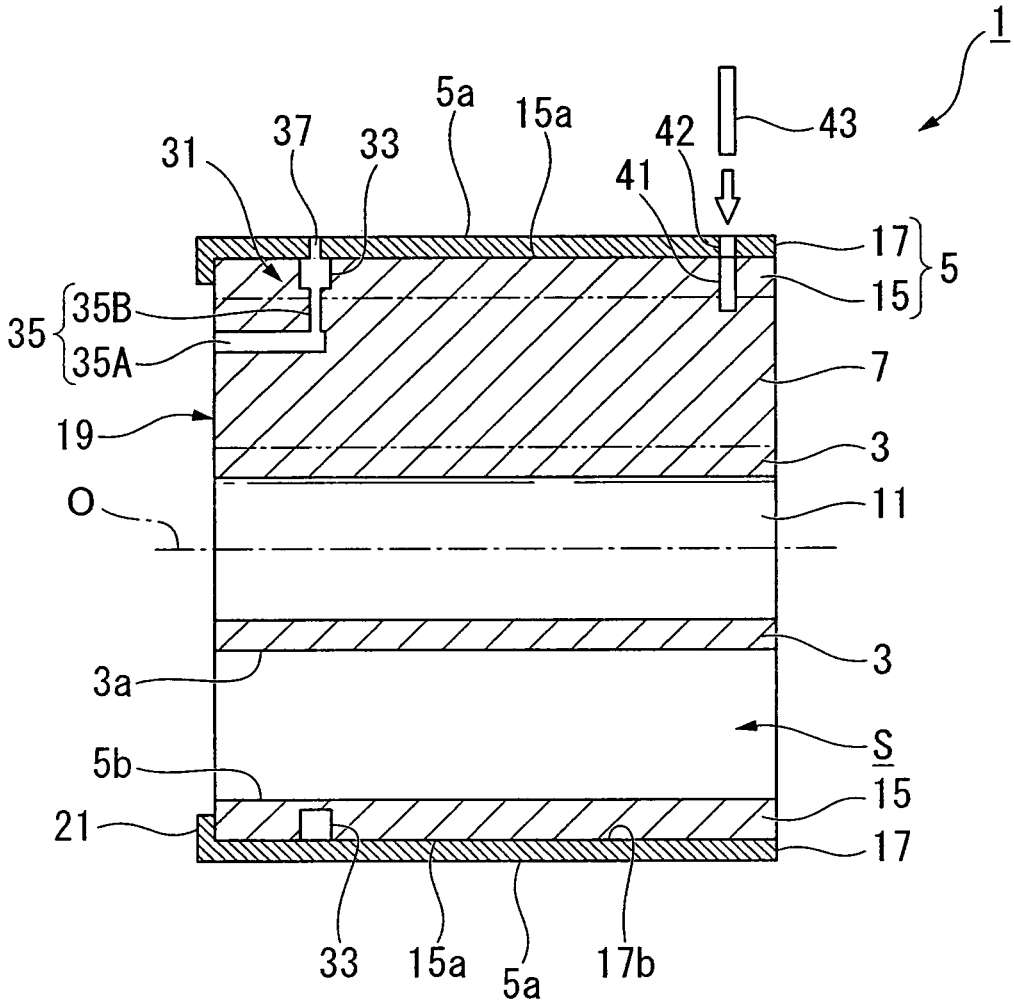
FIG. 2 is a schematic side sectional view of the printing plate cylinder of FIG. 1.
Figure 3:
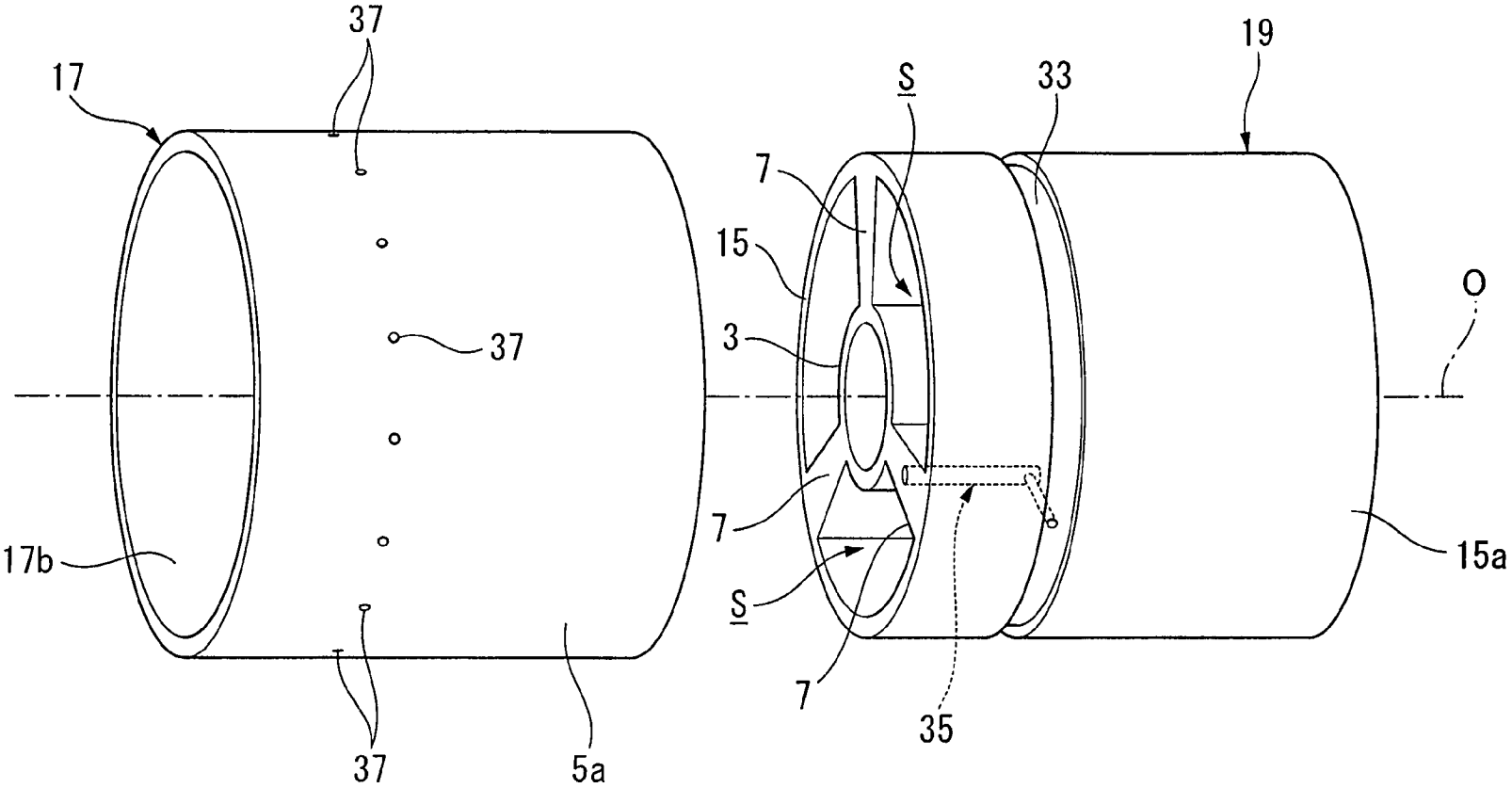
FIG. 3 is a schematic perspective view showing a state where the printing plate cylinder of FIG. 1 is separated into a core member and an outside tubular portion.

Hereinafter, a printing plate cylinder related to a first embodiment of the present invention will be described with reference to FIGS. 1 to 5. As shown in FIGS. 1 to 3, a printing plate cylinder 1 related to this embodiment includes a shaft portion 3 formed cylindrically, a tubular portion 5 formed cylindrically, arranged coaxially with the shaft portion 3, arranged at a distance from an outer circumferential surface 3*a* of the shaft portion 3, and a plurality of ribs 7 (three in the illustrated example) arranged between the shaft portion 3 and the tubular portion 5 to connect the shaft portion and the tubular portion integrally. A sleeve-shaped printing plate P (hereinafter also referred to as a sleeve printing plate P, refer to FIG. 4) is fitted by insertion so as to be brought into close contact with an outer circumferential surface 5*a* of the tubular portion 5.

Here, in the present invention, the "shaft portion" means all the portions, such as a shaft itself, a bearing, a fitting hole, and an inside tubular portion, which are structurally and functionally related to a shaft in the present invention. Additionally, in the present invention, the "axial direction" also includes the meaning of a central axis direction.

A shaft portion 2 (refer to FIG. 4) which is rotationally driven about a central axis O by a driving source (not shown) is inserted into an insertion hole 11 of the shaft portion 3 which penetrates in the axial direction, and the shaft portion 3 is fixed to the shaft portion 2 by inserting the shaft portion 2 into the insertion hole 11. In this fixed state, the torque of the shaft portion 2 is transmitted to the shaft portion 3, so that the printing plate cylinder 1 can be rotated about the central axis O.

Each rib 7 is formed substantially in the shape of a plate which is made narrow in the circumferential direction of the shaft portion 3 or the tubular portion 5, and is formed so as to extend from the outer circumferential surface 3*a* of the shaft portion 3 to an inner circumferential surface 5*b* of the tubular portion 5, and extend along the axial direction of the shaft portion 3. Specifically, each rib 7 has one end portion located radially inward integrally fixed to the outer circumferential surface 3*a* of the shaft portion 3, and the other end integrally fixed to the inner circumferential surface 5*b* of the tubular portion 5. A plurality of ribs 7 is arranged at equal intervals in the circumferential direction of the shaft portion 3. Accordingly, in the printing plate cylinder 1, a gap region S between the shaft portion 3 and the tubular portion 5 is opened to the outside from both axial ends by providing the above-described ribs 7.

The tubular portion 5 includes an inside tubular portion 15 which forms the inner circumferential surface 5*b* thereof, and an outside tubular portion 17 which forms an outer circumferential surface 5*a* of the tubular portion 5, and is press-fitted to the outer circumferential surface 15*a* of the inside tubular portion 15 without a gap. That is, the inside tubular portion 15 is formed integrally with each rib 7, and is formed as an integral core member 19 along with the shaft portion 3 and the plurality of ribs 7.

Although the outside tubular portion 17 and the core member 19 may be formed from the same material, the outside tubular portion and the core member may be formed from mutually different materials. For example, the core member 19 may be formed from a material having good workability, and the outside tubular portion 17 may be formed from a material having rigidity and corrosion resistance. Specifically, the core member 19 may be formed from carbon steel for a mechanical structure, and the outside tubular portion 17 may be formed from stainless steel.

In the core member 19, one air circulation groove 33 depressed from the outer circumferential surface 15*a* of the inside tubular portion 15 is formed over the whole circumferential direction. Additionally, one rib 7 is formed with an air supply passage 35 which penetrates from the axial end surface (outer surface) of the rib to the outer circumferential surface 15*a* of the inside tubular portion 15. That is, an air supply port for introducing air into the air supply passage 35 is formed in the axial end surface of the rib 7. The air supply passage 35 is opened to the bottom of the air circulation groove 33.

The air supply passage 35 is composed of an axial hole 35A which extends along the axial direction from the axial end surface of the rib 7 located at one axial end (a left portion in the illustrated example) of the core member 19, and a radial hole 35B which extends radially inward from the bottom of the air circulation groove 33 so as to communicate with a tip portion of the axial hole 35A.

The outside tubular portion 17 is detachably mounted on the inside tubular portion 15, and has one axial end formed with a flange portion 21 which protrudes further radially inward than its own inner circumferential surface 17*b*.

When the outside tubular portion 17 is press-fitted to the inside tubular portion 15, the flange portion 21 is adapted to abut on the axial end surface of the inside tubular portion 15, and plays a role in positioning the axial position of the outside tubular portion 17 to the inside tubular portion 15. In addition, the flange portion 21 is set so that the internal diameter thereof is greater than the internal diameter of the inner circumferential surface 5*b* of the inside tubular portion 15, and does not protrude further inward than the inner circumferential surface 5*b* of the inside tubular portion 15 in a press-fitted state.

The outside tubular portion 17 is formed with a plurality of air outlet holes 37 which penetrates in the thickness direction (the radial direction) of the outside tubular portion, and the plurality of air outlet holes 37 are arrayed at equal intervals in the circumferential direction of the outside tubular portion 17.

Since the plurality of air outlet holes 37 is arranged on the air circulation groove 33 in a state where the outside tubular portion 17 is mounted as mentioned above, the air outlet holes communicate with the air supply passage 35 by the air circulation groove 33. Since a gap is not generated between the outer circumferential surface 15*a* of the inside tubular portion 15 and the inner circumferential surface 17*b* of the outside tubular portion 17 in a state where the outside tubular portion 17 is mounted on the core member 19, the plurality of air outlet holes 37 constitute the air supply channel 31 which penetrate from the axial direction end surface of the rib 7 to the outer circumferential surface 5*a* of the tubular portion 5, along with the air supply passage 35 and the air circulation groove 33 which are formed in the core member 19.

Figure 4:
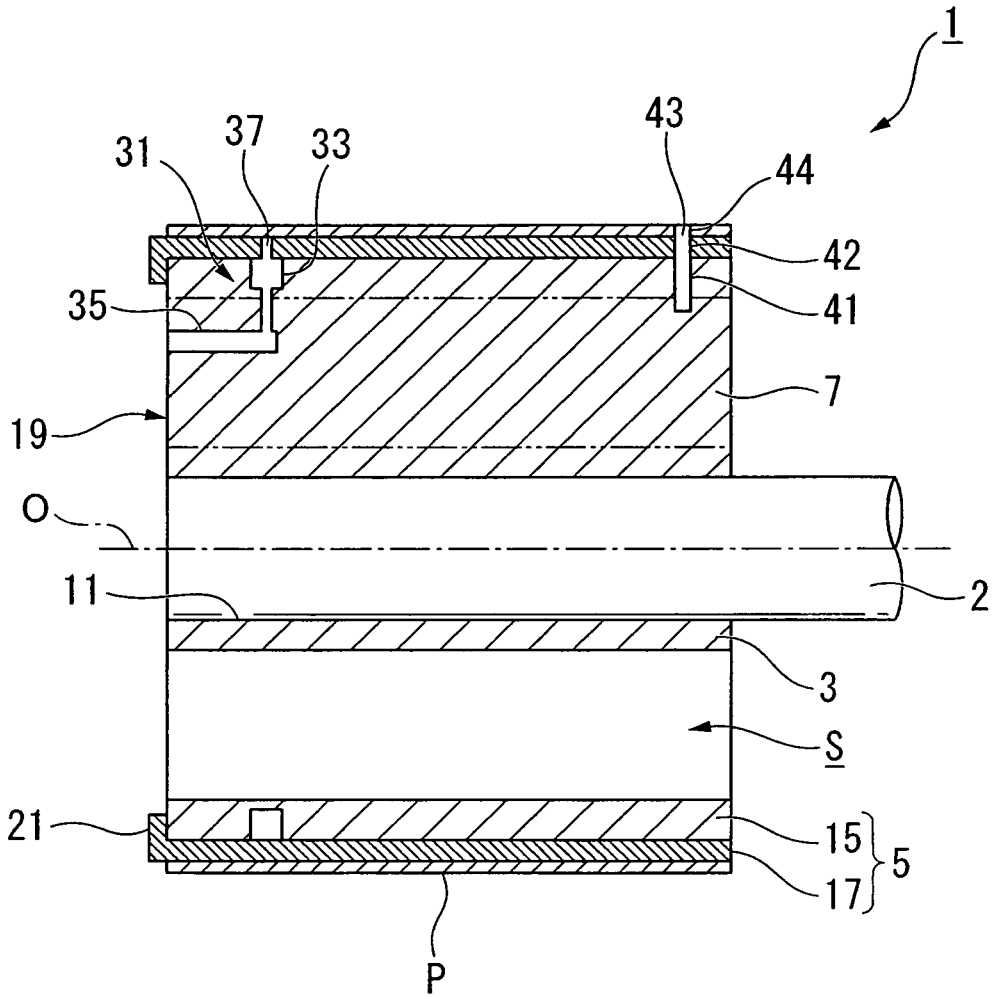
FIG. 4 is a schematic side sectional view showing a state where a shaft portion and a sleeve printing plate are fixed to the printing plate cylinder of FIG. 1.

In addition, in the illustrated example, the air circulation groove 33 and the plurality of air outlet holes 37 are arranged closer to one axial end portion of the printing plate cylinder 1. However, the air circulation groove and the plurality of air outlet holes may be arranged to, for example, an axial intermediate position. In a case where the air circulation groove 33 and the plurality of air outlet holes 37 are arranged to be put close to the one axial end as in the illustrated example, as shown in FIG. 4, it is preferable to form the printing plate cylinder 1 so that the shaft portion 2 is inserted from the other end side of the printing plate cylinder 1 in the axial direction.

The core member 19 and the outside tubular portion 17 are respectively formed with a bottomed hole 41 and a through hole 42 for positioning the relative circumferential positions thereof. That is, the core member 19 is formed with the bottomed hole 41 depressed from the outer circumferential surface 15*a*, and the outside tubular portion 17 is formed with the through hole 42 which penetrates in the thickness direction thereof and has the same diameter as the bottomed hole 41. In a state where the outside tubular portion 17 is mounted on the core member 19, the axial positions of the bottomed hole 41 and the through hole 42 coincide with each other. Accordingly, in this state, the relative circumferential positions of the core member 19 and the outside tubular portion 17 are adjusted so that the bottomed hole 41 and the through hole 42 communicate with each other, and a locating pin 43 is inserted into the bottomed hole 41 and the through hole 42, so that the relative circumferential positions of the core member 19 and the outside tubular portion 17 can also be positioned.

That is, the bottomed hole 41, the through hole 42, and the locating pin 43 constitutes a circumferential positioning means which positions the relative circumferential position of the core member 19 and the outside tubular portion 17.

Next, a method for producing the printing plate cylinder 1 of the above configuration will be described.

When the printing plate cylinder 1 is produced, first, a columnar member (not shown) which becomes a material for the core member 19 is hollowed out in the axial direction, and the shaft portion 3, the ribs 7, and the inside tubular portion 15 are integrally shaped. That is, the hollowed-out portion of the columnar member becomes the insertion hole 11 of the shaft portion 3, or the gap region S between the shaft portion 3 and the inside tubular portion 15, and thereby, the core member 19 is produced. In addition, although the hollowing out of the columnar member which shapes the shaft portion 3, the ribs 7, and the inside tubular portion 15 can be performed by various working methods, it is more preferable that the hollowing out be performed by machining, such as wire cutting work, or cutting work. After this hollowing work, the core member 19 is press-fitted (mounted) into the outside tubular portion 17.

In addition, the production of the outside tubular portion 17 having the flange portion 21 has only to be performed before mounting of the core member 19. Additionally, although the air circulation groove 33, the air supply passage 35, and the bottomed hole 41 of the core member 19, and the air outlet hole 37 and the through hole 42 of the outside tubular portion 17 may be formed in advance in the columnar member before the above-described formation of the gap region S, they may be formed, for example, after the formation of the insertion hole 11 or the gap region S. Here, it is more preferable that the bottomed hole 41 and the through hole 42 be formed altogether in a state where the core member 19 is mounted on the outside tubular portion 17.

Next, a method for attaching and detaching the sleeve-shaped sleeve printing plate P to/from the printing plate cylinder 1 will be described.

When the sleeve printing plate P is attached to and detached from the printing plate cylinder 1, it is only necessary to supply high-pressure air into the air supply passage 35 from the air supply port of the air supply passage 35 opened to the axial end surface of the rib 7, blow off the high-pressure air through the air outlet hole 37 opened to the outer circumferential surface 5*a* of the tubular portion 5, and move the sleeve printing plate P in the axial direction with respect to the printing plate cylinder 1 in this state. In this case, since the sleeve printing plate P is inflated and increased in diameter radially outward by the high-pressure air, the sleeve printing plate P can be smoothly attached and detached.

In addition, in a case where the air circulation groove 33 and the plurality of air outlet holes 37 are arranged closer to one axial end side of the printing plate cylinder 1 as in the illustrated example, it is more preferable to attach and detach the sleeve printing plate P to/from the one axial end side of the printing plate cylinder 1. By doing so in this way, the state where the sleeve printing plate P is inflated radially outward by the high-pressure air can be maintained longer in the process of moving the sleeve printing plate P in the axial direction.

Moreover, in a case where the sleeve printing plate P is mounted on the printing plate cylinder 1, as shown in FIG. 4, it is more preferable to form an insertion hole 44 through which the locating pin 43 is inserted, in the sleeve printing plate P. When the sleeve printing plate P is mounted, it is preferable to insert the locating pin 43 through the insertion hole 44, the through hole 42, and the bottomed hole 41 in a state where high-pressure air is blown off. Thereby, positioning of the sleeve printing plate P with respect to the printing plate cylinder 1 can be easily performed.

In addition, in the illustrated example, the sleeve printing plate P is arranged on the whole outer circumferential surface 5*a* of the outside tubular portion 17. However, as long as the sleeve printing plate is arranged so as to cover the air outlet hole 37, for example, the sleeve printing plate may be arranged only at a portion in the axial direction, of the outer circumferential surfaces 5*a*.

Next, a printing apparatus 50 for a can including the printing plate cylinder 1 on which the sleeve printing plate P is mounted will be described.

Figure 5:
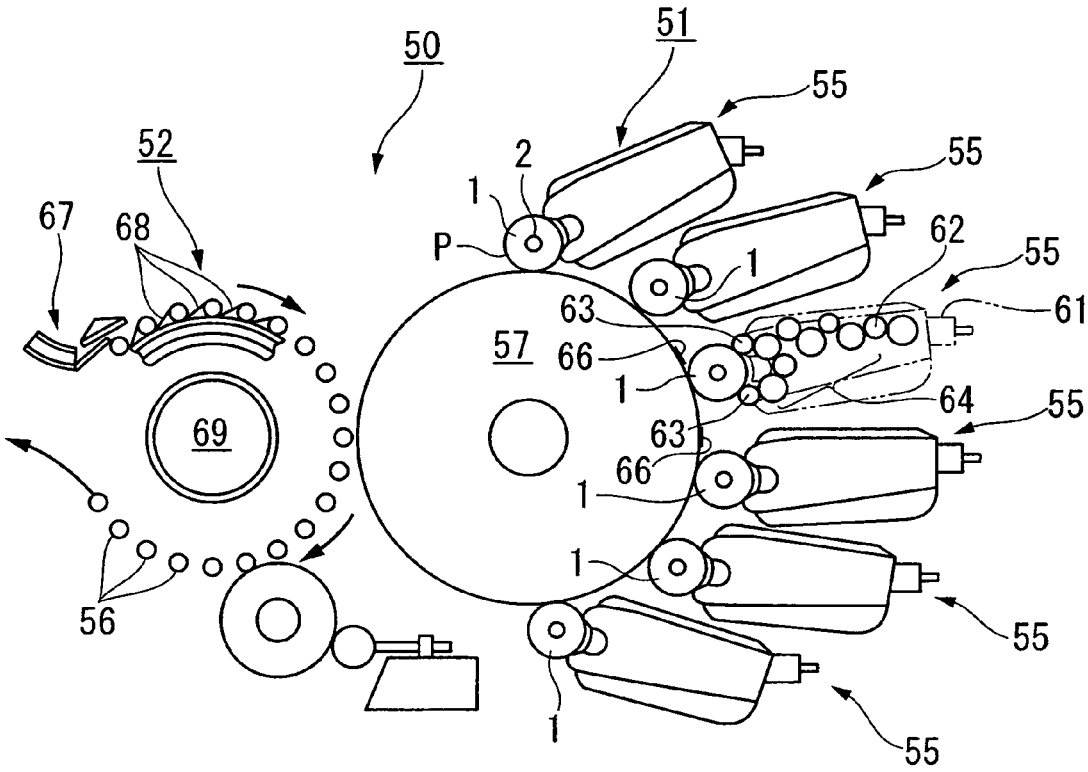
FIG. 5 is a schematic view showing a printing apparatus for a can using the printing plate cylinder of FIG. 1.

As shown in FIG. 5, the printing apparatus 50 for a can has an ink adhering mechanism 51 and a can moving mechanism 52.

The ink adhering mechanism 51 includes a plurality of inker units 55 which is provided in respective colors to be printed, and a blanket wheel 57 which transfers the ink transferred from each inker unit 55 to the outer circumferential surface of a substantially cylindrical workpiece (can) 56 on which a size coat film is formed.

Each inker unit 55 has an ink source 61 which is filled with the color ink to be printed, a ducting roller 62 which comes into contact with the ink source 61 and receives the ink, an intermediate roller 64 composed of a plurality of rollers which deliver the ink to a rubber roller 63 from the ducting roller 62, and the printing plate cylinder 1 which comes into contact with the rubber roller 63. The outer circumferential surface of the printing plate cylinder 1 is mounted with the sleeve-shaped sleeve printing plate P which forms an image portion by laser engraving, etching or the like, and the printing plate cylinder 1 is rotatably supported by the shaft portion 2 of the printing apparatus 50 for a can.

Additionally, the outer circumferential surface of the blanket wheel 57 is provided with a plurality of blankets 66 which comes into contact with the sleeve printing plate P of the printing plate cylinder 1.

The can moving mechanism 52 includes a can shooter 67 which introduces a workpiece 56, a mandrel 68 which rotatably holds the workpiece 56 supplied from the can shooter 67, and a mandrel turret 69 which rotationally moves the workpiece 56 mounted on the mandrel 68 in the direction of the ink adhering mechanism 51 sequentially.

In the printing apparatus 50 for a can, each different color ink adheres to the sleeve printing plate P mounted on the outer circumferential surface of the printing plate cylinder 1 via the ducting roller 62, the intermediate roller 64, and the rubber roller 63 from the ink source 61 of each inker unit 55. Then, each ink is put on the blanket 66 on the rotating blanket wheel 57 from each sleeve printing plate P as a pattern, and this pattern is printed while coming into contact with a can barrel of the workpiece 56 held by the mandrel 68. Then, the patterns of the respective color inks overlap each other so that one pattern is printed on the can barrel. That is, a pattern to be printed on the can barrel is formed by overlapping patterns of image portions for respective colors formed on the sleeve printing plates P of the printing plate cylinders 1.

According to the above printing plate cylinder 1, since the shaft portion 3 and the tubular portion 5 are connected together by the ribs 7, it is possible to make the diameter of the shaft portion 3 small or to make the thickness of the tubular portion 5 thin, and it is possible to easily reduce the weight of the printing plate cylinder 1.

Additionally, since the gap region S between the shaft portion 3 and the tubular portion 5 can be opened to the outside from both axial ends of the printing plate cylinder 1 by connecting the shaft portion 3 and the tubular portion 5 together by the ribs 7, it is possible to efficiently cool the printing plate cylinder 1 by, for example, making cooling air flow to this gap region at the time of printing. That is, the heat radiation at the time of printing can be improved, and the viscosity of ink can be stabilized to prevent an occurrence of printing unevenness.

Moreover, since a large air chamber is not provided in the printing plate cylinder 1 unlike the conventional printing plate cylinder, simply by forming the air supply channel 31 with small volume from the ribs 7 to the tubular portion 5, even if the pressure of the air supply channel 31 drops sharply, formation of dew can be minimized. As a result, generation of rust on the printing plate cylinder 1 can be suppressed, and deterioration of attachability and detachability of the sleeve printing plate P to the printing plate cylinder 1 can be prevented.

Additionally, by constituting the air supply channel 31 by the air supply passage 35, the air circulation groove 33, and the air outlet hole 37, it is possible to evenly deliver the high-pressure air introduced into the air supply passage 35 in the circumferential direction by the air circulation groove 33. Therefore, even if the number of the air supply passages 35 is fewer than the number of the air outlet holes 37, it is possible to uniformly blow off the high-pressure air introduced into the air supply passage 35 through each air outlet hole 37.

Moreover, since the air supply passage 35 and the air circulation groove 33 can be easily formed in the core member 19, and the air outlet hole 37 can also be easily formed in the outside tubular portion 17, the air supply channel 31 through which air is guided from the air supply port to the air outlet hole 37 can be simply formed. For example, the air supply passage 35 can be easily formed simply by forming the axial hole 35A from the axial end surface of the rib 7, and forming the radial hole 35B from the outer circumferential surface 15*a* of the inside tubular portion 15 so as to communicate with the axial hole 35A.

Additionally, in a case where the core member 19 or the columnar member which becomes a material of the core member is formed from a material having good workability like carbon steel for a mechanical structure or the like, hollowing work for shaping the shaft portion 3, the ribs 7, and the inside tubular portion 15, and forming work of the air circulation groove 33 and the air supply passage 35 can be easily performed.

Moreover, in a case where the outside tubular portion 17 is formed from a material having rigidity and corrosion resistance like stainless steel or the like, when printing is performed on a can by the printing apparatus 50, the outside tubular portion 17 can be prevented from deforming or corroding due to ink or the like.

According to the printing apparatus 50 including the printing plate cylinder 1, it is possible to provide the lightweight printing plate cylinder 1, thereby reducing the weight of the printing apparatus 50. Additionally, since occurrence of printing unevenness can be suppressed at the time of printing, the yield of cans can be improved.

Moreover, since generation of rust in the printing plate cylinder 1 can also be suppressed, it is possible to use the same printing plate cylinder 1 over a long period of time without replacement, and it is consequently possible to reduce the running cost of the printing apparatus 50.

Additionally, according to the method for producing the printing plate cylinder 1, since the core member 19 is press-fitted to the outside tubular portion 17 after a columnar member is hollowed in the axial direction thereof to integrally shape the shaft portion 3, the ribs 7, and the inside tubular portion 15 to produce the core member 19, it is possible to prevent occurrence of deviation in the external diameter of the inside tubular portion 15 with respect to the internal diameter of the outside tubular portion 17. That is, it is possible to shape the inside tubular portion 15 with high accuracy. Particularly, the shapes of the shaft portion 3, the ribs 7, and the inside tubular portion 15 can be finished still with high accuracy by performing the above shaping by machining, such as wire cutting work or cutting work.

Figure 6:
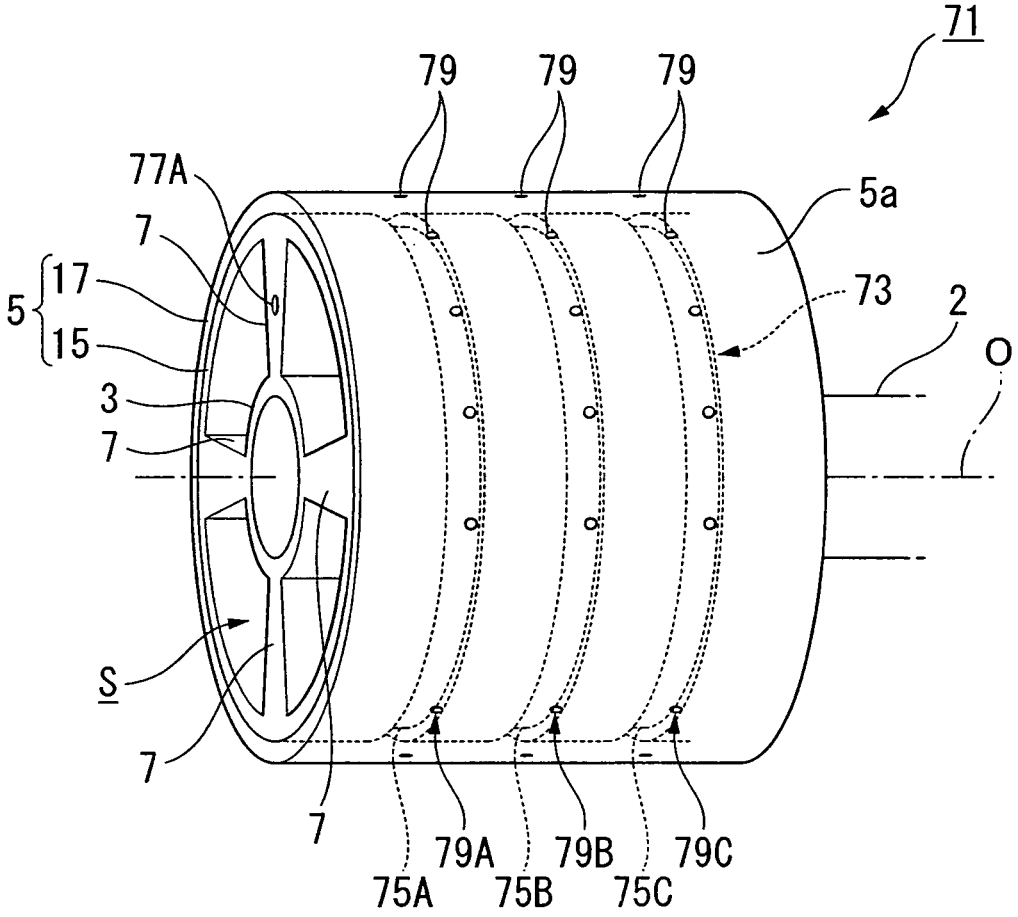
FIG. 6 is a schematic perspective view showing a state where a printing plate cylinder related to a second embodiment of the present invention is fixed to the shaft portion.
Figure 7:
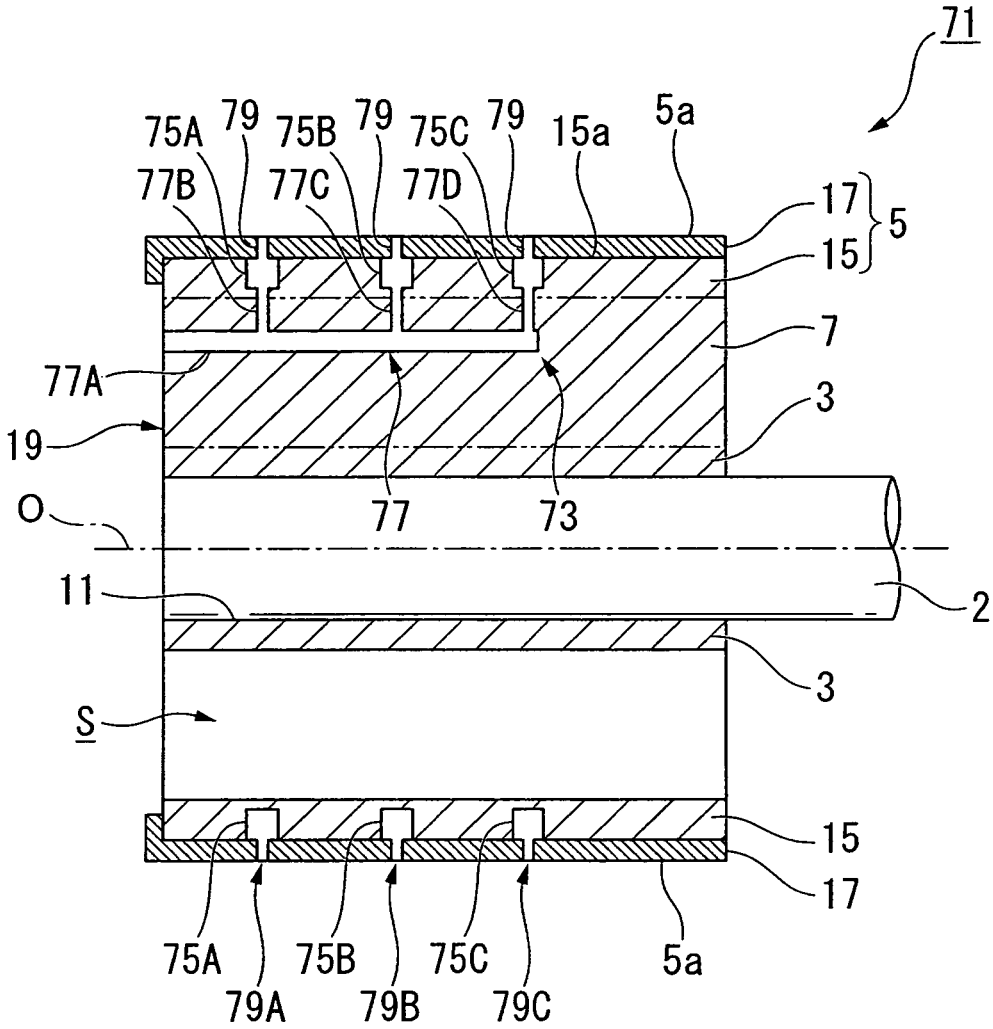
FIG. 7 is a schematic side sectional view of the printing plate cylinder of FIG. 6.

Next, a printing plate cylinder related to a second embodiment of the present invention will be described with reference to FIGS. 6 and 7. As shown in FIGS. 6 and 7, a printing plate cylinder 71 of the present embodiment, similarly to the first embodiment, includes the core member 19 in which the shaft portion 3, the plurality of ribs 7, and the inside tubular portion 15 are integrally formed, and the outside tubular portion 17 which is press-fitted to the outer circumferential surface 15*a* of the inside tubular portion 15 without a gap, but is different from the first embodiment in terms of the configuration of the air supply channel 73 which penetrates from the axial end surface of the rib 7 to the outer circumferential surface 5*a* of the tubular portion 5.

In addition, in the present embodiment, although four ribs 7 are formed, a plurality of ribs has only to be arranged at equal intervals at least in the circumferential direction of the shaft portion 3. For example, three ribs may be formed similarly to the first embodiment.

The air supply channel 73 includes a plurality of air circulation grooves 75A, 75B, and 75C (three in the illustrated example) which is formed by being depressed from the outer circumferential surface 15*a* of the inside tubular portion 15, an air supply passage 77 which penetrates from the axial end surface of one rib 7 to the bottom of each of the air circulation grooves 75A, 75B, and 75C, and a plurality of air outlet holes 79 which penetrates in the thickness direction of the outside tubular portion, and is arranged on the air circulation grooves 75A, 75B, and 75C.

Each of the air circulation grooves 75A, 75B, and 75C, similarly to the first embodiment, is formed over the whole circumferential direction of the outer circumferential surface 15*a* of the inside tubular portion 15, and the plurality of air circulation grooves 75A, 75B, and 75C is arranged in the direction of the central axis O at intervals from each other.

The air supply passage 77 is composed of one axial hole 77A which extends in the direction of the central axis O from the axial end surface of one rib 7, and a plurality of radial holes 77B, 77C, and 77D (three in the illustrated example) which extend radially inward from the bottom of each of the air circulation grooves 75A, 75B, and 75C so as to communicate with the axial hole 77A, respectively.

Additionally, the plurality of air outlet holes 79 which is arranged on the same air circulation grooves 75A, 75B, and 75C is arrayed at equal intervals in the circumferential direction of the outside tubular portion 17, and constitutes air outlet groups 79A, 79B, and 79C, respectively. The plurality of air outlet groups 79A, 79B, and 79C are arranged in the direction of the central axis O at intervals from each other so as to match the arrangement of the plurality of air circulation grooves 75A, 75B, and 75C.

The printing plate cylinder 71 of the above configuration can be produced similarly to the first embodiment.

Even when the sleeve printing plate P is attached to and detached from the printing plate cylinder 71, similarly to the first embodiment, it is only necessary to supply high-pressure air into the air supply channel 73 from the air supply port of the air supply channel 73 opened to the axial end surface of the rib 7, blow off the high-pressure air through the air outlet hole 79 of the air supply channel 73 opened to the outer circumferential surface 5*a* of the tubular portion 5, and move the sleeve printing plate P in the axial direction with respect to the printing plate cylinder 1 in this state.

Additionally, this printing plate cylinder 71 can also be used for the printing apparatus 50 for a can described in the first embodiment.

According to the above-mentioned printing plate cylinder 71, the same effects as those of the first embodiment are exhibited. Moreover, in this configuration, high-pressure air can be blown off through a plurality of axial places of the outer circumferential surface 5*a* of the outside tubular portion 17. Therefore, in the process of detaching and attaching the sleeve printing plate P, the inflation state of the sleeve printing plate P by the high-pressure air can be maintained lengthily, and it is possible to smoothly attach and detach the sleeve printing plate.

Figure 8:
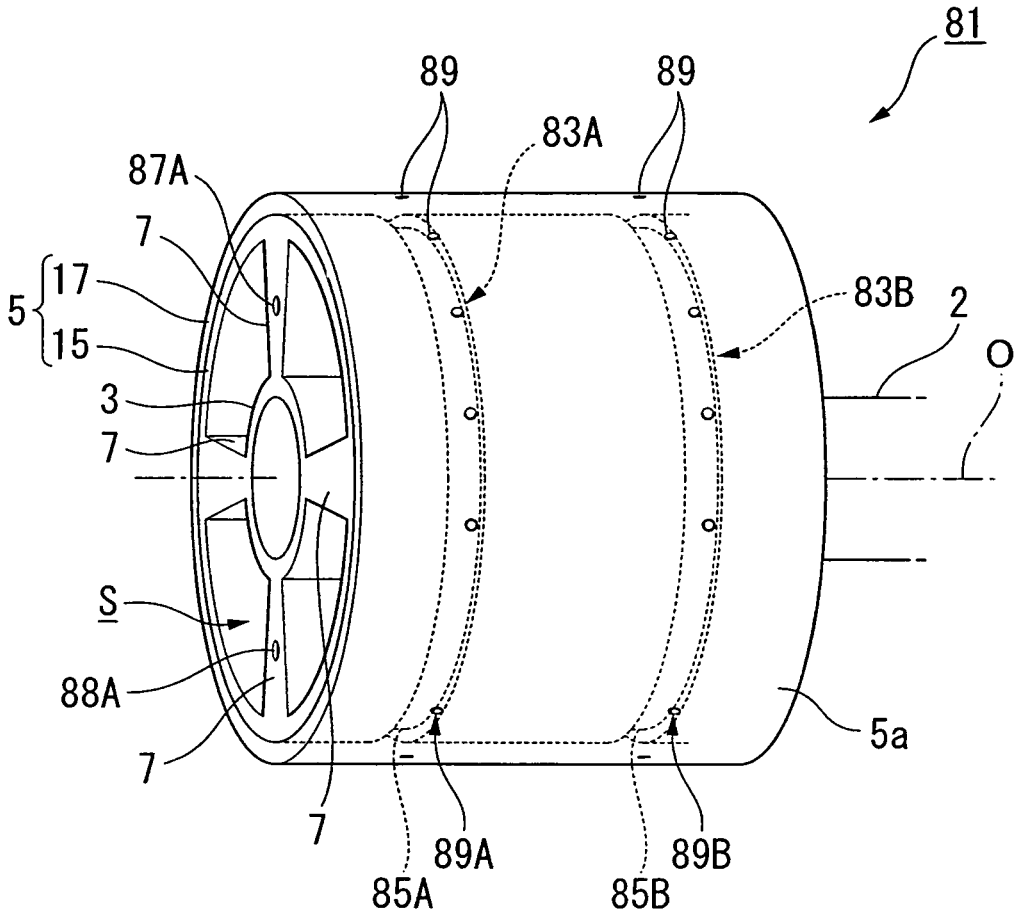
FIG. 8 is a schematic perspective view showing a state where a printing plate cylinder related to a third embodiment of the present invention is fixed to the shaft portion.
Figure 9:
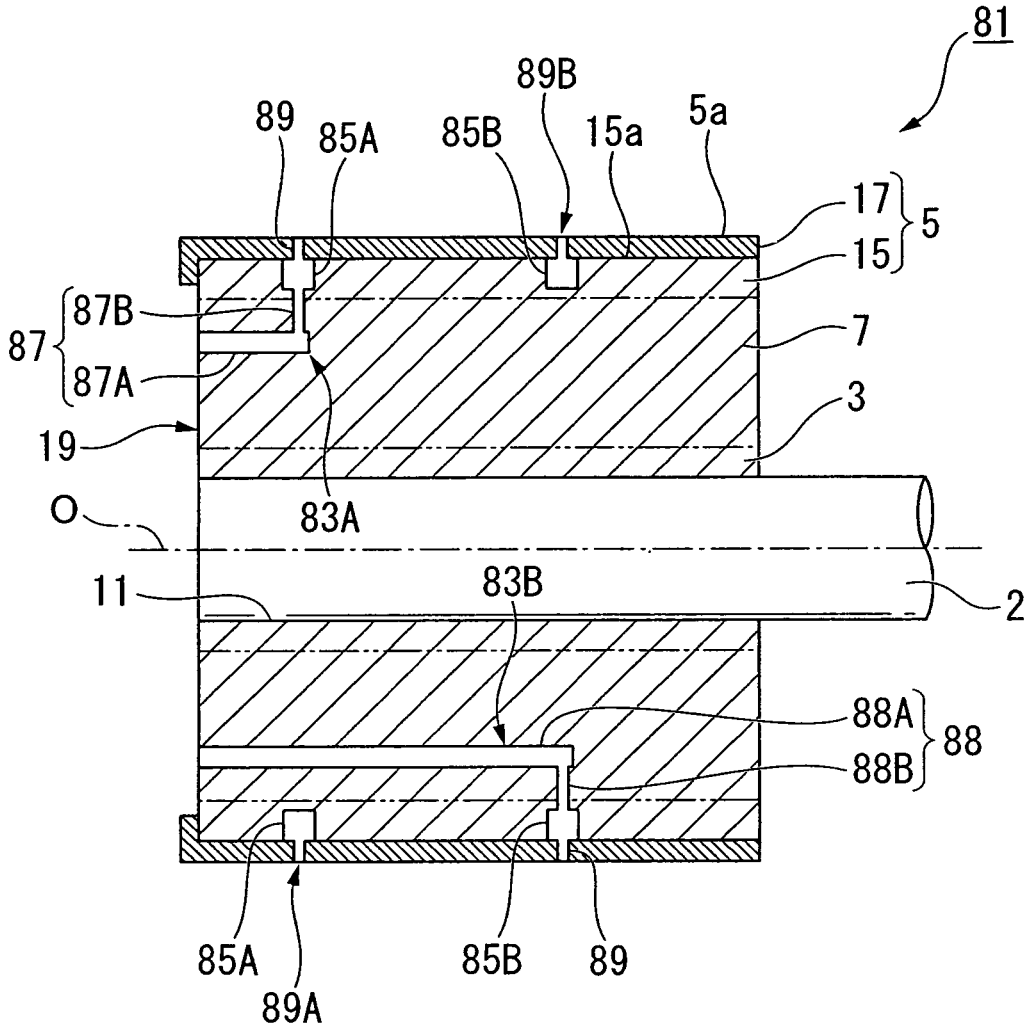
FIG. 9 is a schematic side sectional view of the printing plate cylinder of FIG. 8.

Next, a printing plate cylinder related to a third embodiment of the present invention will be described with reference to FIGS. 8 and 9. As shown in FIGS. 8 and 9, a printing plate cylinder 81 of the present embodiment, similarly to the above-described two embodiments, includes the core member 19 in which the shaft portion 3, the plurality of ribs 7, and the inside tubular portion 15 are integrally formed, and the outside tubular portion 17 which is press-fitted to the outer circumferential surface 15*a* of the inside tubular portion 15 without a gap, but is different from the above two embodiments in terms of including a plurality of air supply channels.

In the printing plate cylinder 81, a plurality of air circulation grooves 85A and 85B (two in the illustrated example) which is formed by being depressed from the outer circumferential surface 15*a* are formed in the inside tubular portion 15, and is arranged in the direction of the central axis O at intervals from each other.

Additionally, the outside tubular portion 17 is formed with a plurality of air outlet holes 89 which penetrates in the thickness direction thereof, and is arranged on the air circulation grooves 85A and 85B. Also, the plurality of air outlet holes 89 which is arranged on the same air circulation grooves 85A and 85B is arrayed at equal intervals in the circumferential direction of the outside tubular portion 17, and constitutes respective air outlet groups 89A and 89B. Moreover, the plurality of air outlet groups 89A and 89B is arranged in the direction of the central axis O at intervals from each other so as to match the arrangement of the plurality of air circulation grooves 85A and 85B.

The plurality of ribs 7 (four in the illustrated example) which is axisymmetrically located about on the central axis O is formed with a plurality of air supply passages 87 and 88 (two in the illustrated example) which penetrates from the axial end thereof to the bottom of each of the air circulation grooves 85A and 85B. That is, the air supply passages 87 and 88 individually communicate with the plurality of air circulation grooves 85A and 85B which is arrayed in the axial direction.

Here, the first air supply passage 87 which communicates with the first air circulation groove 85A is composed of an axial hole 87A which extends in the direction of the central axis O from the axial end surface of the rib 7, and a radial hole 87B which extends radially inward from the bottom of the first air circulation groove 85A so as to communicate with the axial hole 87A.

Additionally, the second air supply passage 88 which communicates with the second air circulation groove 85B is composed of an axial hole 88A which extends in the direction of the central axis O from the axial end surface of the rib 7, and a radial hole 88B which extends radially inward from the bottom of the first air circulation groove 85B so as to communicate with the axial hole 88A.

The first air supply channel 83A is constituted by the first air circulation groove 85A, the first air supply passage 87, and the first air outlet group 89A. Additionally, the second air supply channel 83B is constituted by the second air circulation groove 85B, the second air supply passage 88, and the second air outlet group 89B.

The printing plate cylinder 81 of the above configuration can be produced similarly to the above-described two embodiments, and can be used for the same printing apparatus 50 for a can.

According to this printing plate cylinder 81, the same effects as those of the above two embodiments are exhibited. Additionally, it is possible to individually control supply of high-pressure air to the individual air outlet groups 89A and 89B which are respectively formed in axial places. Accordingly, when the sleeve printing plate P is moved in the axial direction and the sleeve printing plate P is attached to and detached from the printing plate cylinder 81, high-pressure air can be blown off through only the air outlet group 89A and 89B which are covered with the sleeve printing plate P. That is, it is also possible to exhibit the effect that high-pressure air can be prevented from being blown off wastefully, and the sleeve printing plate P can be efficiently attached and detached.

In addition, the present invention is not limited to the above-described three embodiments, and can be modified without departing from the spirit and scope of the present invention. For example, although the air circulation grooves 33, 75A to 75C, 85A, and 85B are formed in the outer circumferential surface 15*a* of the inside tubular portion 15, it is only necessary to form the air circulation grooves so that the air supply passages 35, 77, 87, and 88 and the plurality of air outlet holes 37, 79, and 89 communicate with each other. That is, the air circulation grooves 33, 75A to 75C, 85A, and 85B may be formed in the inner circumferential surface 17*b* of the outside tubular portion 17.

In this case, the air outlet holes 37, 79, and 89 are opened to the bottom portions of the air circulation grooves 33, 75A to 75C, 85A, and 85B, and the opening portions of the air supply passages 35, 77, 87, and 88 which are opened to the outer circumferential surface 15*a* of the inside tubular portion 15 are arranged to face the air circulation grooves 33, 75A to 75C, 85A, and 85B. Additionally, the air circulation grooves 33, 75A to 75C, 85A, and 85B may be formed, for example, in both the outer circumferential surface 15*a* of the inside tubular portion 15, and the inner circumferential surface 17*b* of the outside tubular portion 17.

Additionally, although the air circulation grooves 33, 75A to 75C, 85A, and 85B are formed over the whole circumferential direction in the outer circumferential surface 15*a* of the inside tubular portion 15 or the inner circumferential surface 17*b* of the outside tubular portion 17, for example, a plurality of air circulation grooves 33, 75A to 75C, 85A, and 85B may be split and formed in the circumferential direction, and the plurality of split air circulation grooves 33, 75A to 75C, 85A, and 85B may communicate with the individual air supply passages 35, 77, 87, and 88, respectively. That is, in this case, it is only necessary to form the plurality of air circulation grooves 33, 75A to 75C, 85A, and 85B so that the air outlet holes 37, 79, and 89 which are arrayed over the circumferential direction communicate with any one of the air supply passages 35, 77, 87, and 88.

Moreover, although air supply ports of the air supply passages 35, 77, 87, and 88 are formed in the axial end surfaces of the ribs 7, the air supply ports are not limited thereto, and have only to be formed at positions where air can be introduced into the air supply passages 35, 77, 87, and 88. That is, the air supply ports can be formed at arbitrary positions, such as positions where the sleeve printing plate P is not disposed, in the outer surface of the rib 7 which is exposed to the outside or the like, the outer circumferential surface 3*a* and axial end surface of the shaft portion 3, the inner circumferential surface 5*b* of the tubular portion 5, and the outer circumferential surface 5*a* of the tubular portion 5. In addition, an example of the outer surface of the rib 7 includes the side surface of the rib 7 which extends along the central axis O, including the axial end surface of the rib 7.

Additionally, although the air supply passages 35, 77, 87, and 88 are composed of the axial holes 35A, 77A, 87A, and 88A and the radial holes 35B, 77B to 77D, 87B, and 88B which extend in directions orthogonal to each other, it is only necessary to form the air supply passages from the axial end surfaces of the ribs 7 to the insides of the air circulation grooves 33, 75A to 75C, 85A, and 85B. That is, the air supply passage 35 may be formed to extend linearly to the bottom of the air circulation grooves 33, 75A to 75C, 85A, or 85B from the axial end surface of the rib 7, for example, so as to incline with respect to the axial direction.

Moreover, although the outside tubular portion 17 is press-fitted to the outer circumferential surface 15*a* of the inside tubular portion 15 without a gap, since communicating portions between the air circulation grooves 33, 75A to 75C, 85A, and 85B and the air outlet holes 37, 79, and 89 have only to be sealed from the outside, particularly, the outside tubular portion may not be press-fitted. That is, the gap may be formed between the inner circumferential surface 17*b* of the outside tubular portion 17 and the outer circumferential surface 15*a* of the inside tubular portion 15 as long as the outside tubular portion is at a position apart from communicating portions between the air circulation grooves 33, 75A to 75C, 85A, and 85B and the air outlet holes 37, 79, and 89. Accordingly, even when the printing plate cylinder 1 is produced, the columnar member has only to be mounted on the outside tubular portion 17 without necessarily press-fitting the core member 19 to the outside tubular portion 17.

Additionally, although the core member 19 is produced by carrying out hollowing by machining, such as wire cutting work or cutting work, the core member is not limited thereto, and may be produced by, for example, casting.

Moreover, although the printing plate cylinder 1 is formed so as to be split into the outside tubular portion 17 and the core member 19, the outside tubular portion and the core member may be integrally formed. That is, the tubular portion 5 may have a configuration in which the outside tubular portion 17 and the inside tubular portion 15 are integrally formed. In this case, it is only necessary to directly connect the air supply passages 35, 77, 87, and 88 formed in the ribs 7 to the air outlet holes 37, 79, and 89 formed in the tubular portion 5, without forming the air circulation grooves 33, 75A to 75C, 85A, and 85B. Even if this configuration is adopted, similarly to the above embodiments, it is possible to reduce the weight of the printing plate cylinder 1, improve heat radiation at the time of printing, and suppress formation of dew.

Figure 10:
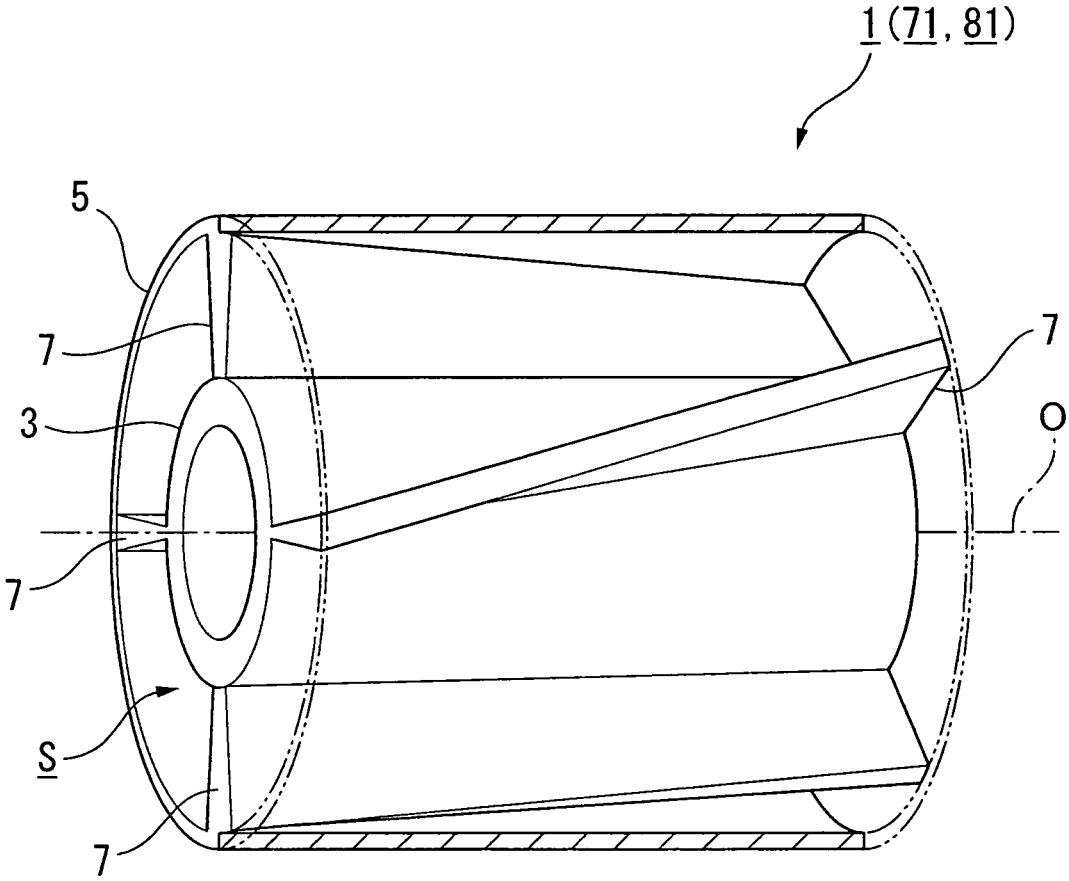
FIG. 10 is a partial transmissive perspective view showing the outline of a printing plate cylinder related to other embodiment of the present invention.

Additionally, for example, fins which generate an air stream in the gap region S with the rotation of the printing plate cylinders may be disposed in the printing plate cylinders 1, 71, and 81 of the above embodiments. Specifically, for example, as shown in FIG. 10, the aforementioned fins have only to be constructed by inclining a plurality of ribs 7 about the central axis O so as to be twisted in the same circumferential direction.

In this case, since the printing plate cylinders 1, 71, and 81 are cooled as the printing plate cylinders 1, 71, and 81 rotate at the time of printing to generate an air stream in the gap region S, temperature can be prevented from rising excessively even at the time of continuous operation. Accordingly, the temperature rise of the ink to be applied to the sleeve printing plate P attached to the printing plate cylinder 1, 71, or 81 is suppressed to stabilize ink viscosity, and consequently, occurrence of printing unevenness can be more effectively prevented.

Additionally, by constructing the ribs 7 as the fins, the printing plate cylinders 1, 71, and 81 can be cooled without increasing the number of parts of the printing plate cylinders 1, 71, and 81, or complicating the shape of the members.

Moreover, although the blowoff of the high-pressure air from the air outlet holes 37, 79, and 89 is performed when the sleeve printing plate P is attached to and detached from the printing plate cylinders 1, 71, and 81, the blowoff has only to be performed when the sleeve printing plate P is mounted to the printing plate cylinders 1, 71, and 81. When the sleeve printing plate P is removed from the printing plate cylinder 1, 71, or 81, for example, the sleeve printing plate P may be cut by a cutter or the like.

Figure 11:
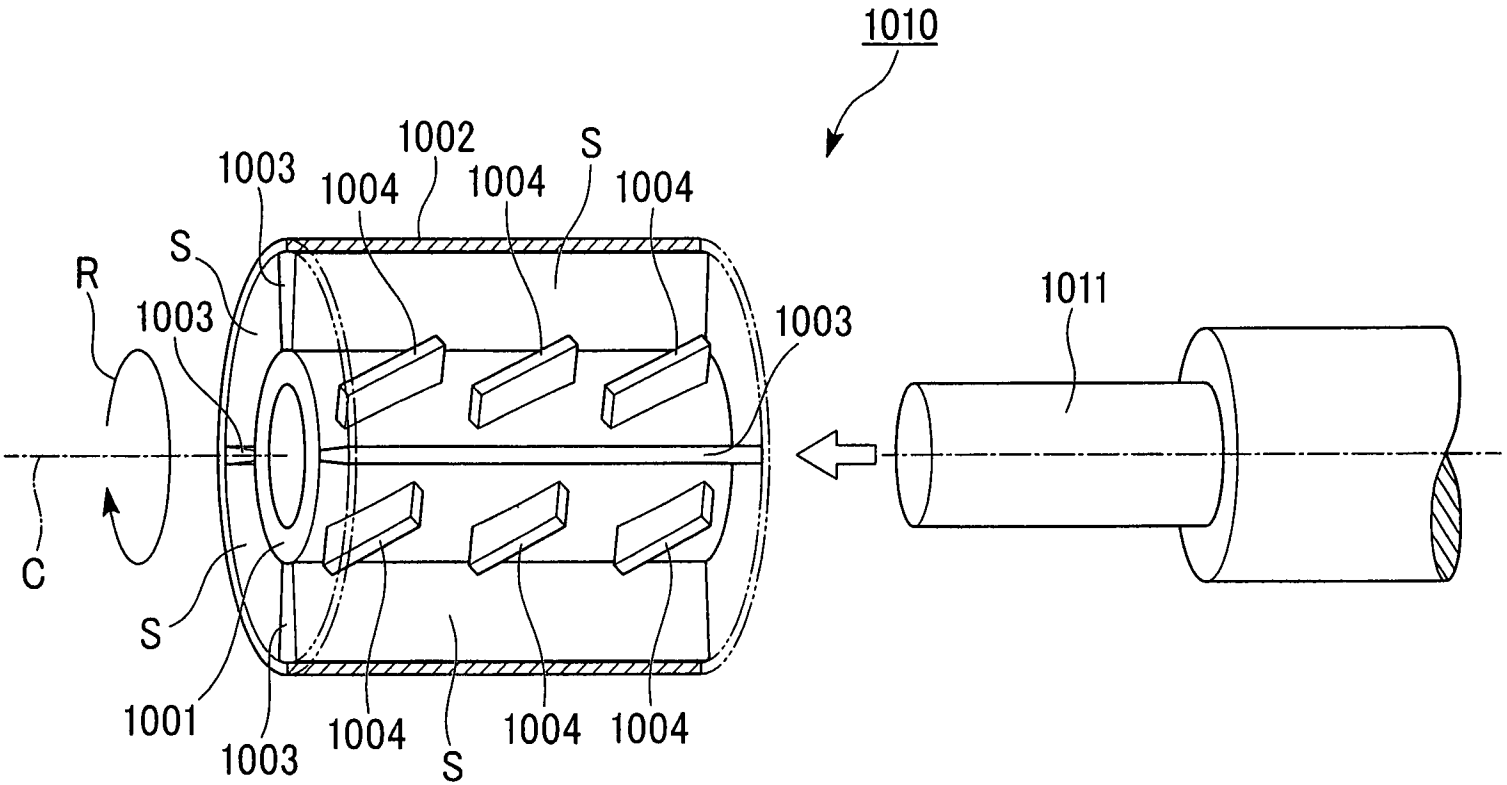
FIG. 11 is a partial transmissive perspective view showing the schematic configuration of a printing plate cylinder related to a fourth embodiment of the present invention.
Figure 12:
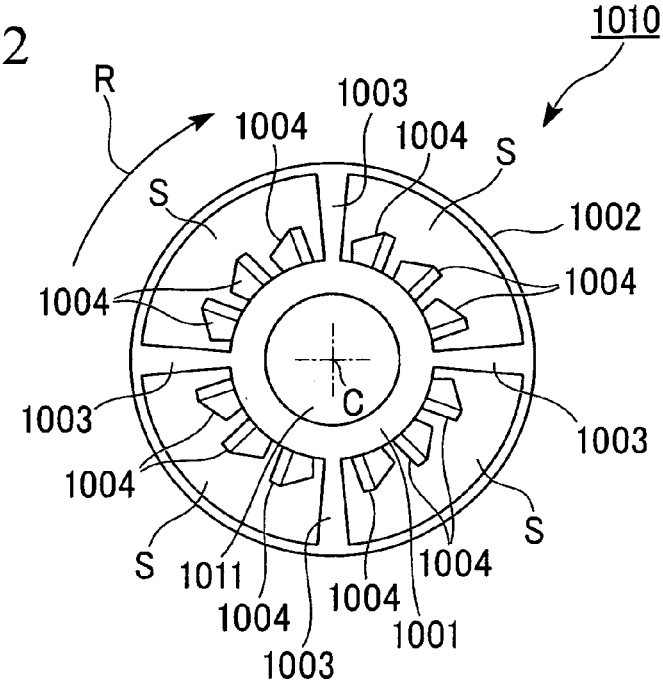
FIG. 12 is a schematic side view showing the printing plate cylinder related to the fourth embodiment of the present invention.
Figure 13:
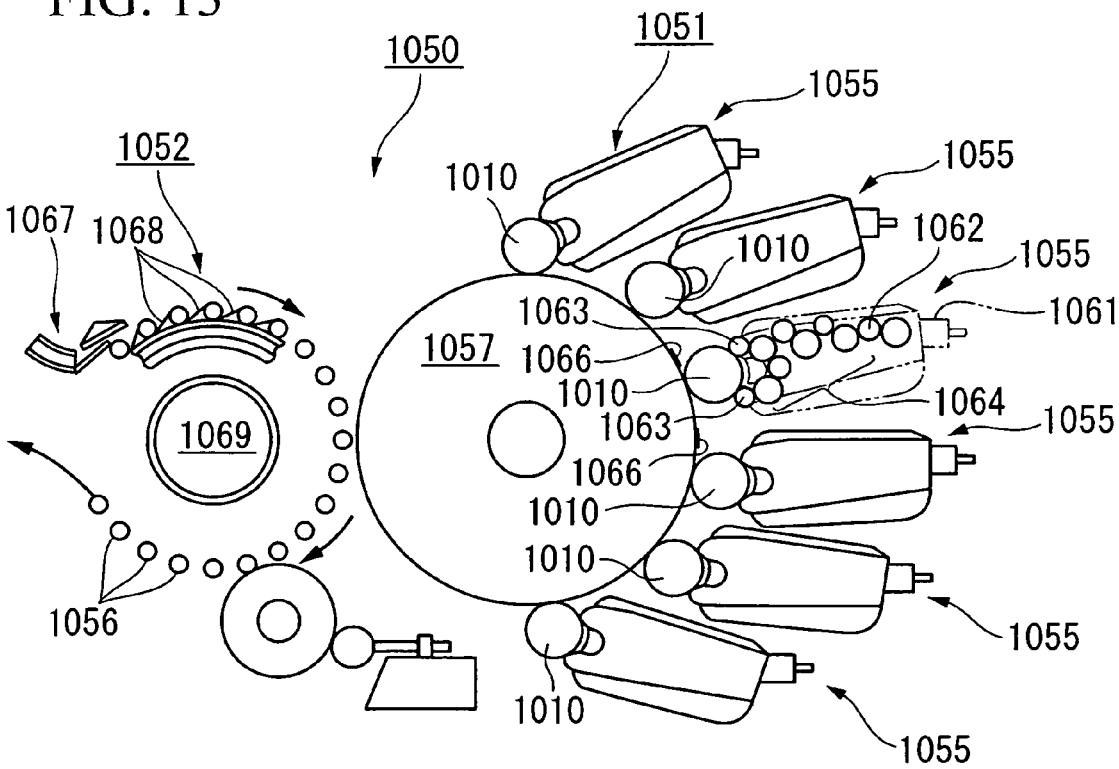
FIG. 13 is a schematic view showing a printing apparatus for a can using the printing plate cylinder of the fourth embodiment of the present invention.

FIG. 11 is a partial transmissive perspective view showing the schematic configuration of a printing plate cylinder related to a fourth embodiment of the present invention, FIG. 12 is a schematic side view showing the printing plate cylinder related to the fourth embodiment of the present invention, and FIG. 13 is a schematic view showing a printing apparatus for a can using the printing plate cylinder of the fourth embodiment of the present invention.

A printing plate cylinder 1010 of the fourth embodiment is formed cylindrically, includes a printing plate which has a printing design (image portion) given to the outer circumferential surface thereof, and is made of resin (not shown), and is disposed at a printing apparatus for a can which has a beverage can, etc. as an object to be printed. As kinds of printing, relief printing, for example, offset printing, or flexographic printing capable of performing printing with low printing pressure is adopted. Additionally, in the present embodiment, the CTS technique is used, which is a technique of using a cylindrical sleeve member (not shown) attachable to and detachable from an outer circumferential surface, directly laser-machining a printing plate arranged at the sleeve member to form an image portion with good workability, and then attaching and detaching each sleeve member to/from the outer circumferential surface of the printing plate cylinder 1010.

As shown in FIGS. 11 and 12, the printing plate cylinder 1010 includes a cylindrical shaft portion 1001 which is rotated about the central axis C, and a cylindrical tubular portion 1002 which is disposed coaxially with the shaft portion 1001 outside the shaft portion 1001, and is set to almost the same length as the shaft portion 1001 in the direction of the central axis C. The tubular portion 1002 is formed so as to be thinner compared to the shaft portion 1001, and is reduced in weight, and a plurality of substantially flat-plate-shaped ribs 1003 which extend parallel to the central axis C are disposed uniformly in the circumferential direction so as to connect the inner circumferential surface of the tubular portion 1002 and the outer circumferential surface of the shaft portion 1001 together. Additionally, the space between the shaft portions 1001 and the tubular portion 1002 serves as the region S, and both ends of the region S in the direction of the central axis C are open to the ambient air.

A tip portion of a driving shaft 1011 which is installed at a main body of the printing apparatus to drive the printing plate cylinder 1010 in the rotational direction R is inserted into the shaft portion 1001. The internal diameter of the shaft portion 1001 and the external diameter of the tip portion of the driving shaft 1011 are set to almost the same dimension so as to fit to each other, and are made immovable to each other in the rotational direction R by a key member or the like, which is not shown in the fitted integral state. Additionally, the shaft portion 1001 and the driving shaft 1011 are attachable to and detachable from each other.

Additionally, as for the printing plate cylinder 1010, for example, the external diameter is set to about ϕ200 mm, the length in the direction of the central axis C is set to about 190 mm, and the number of revolutions is set to 800 rpm or less.

Additionally, a plurality of substantially flat-plate-shaped fins 1004 is erected from the outer circumferential surface of the shaft portion 1001 with the outer circumferential surface at base ends. As shown in FIG. 12, the fins 1004 are disposed uniformly in the circumferential direction on the outer circumferential surface of the shaft portion 1001, and the height thereof extending radially outward from the outer circumferential surface of the shaft portion 1001 is set to be slightly shorter than substantially the central portion of the region S in the radial direction. Additionally, in a state where the shaft portion 1001 and the driving shaft 1011 are fitted to each other, each fin 1004 is substantially spirally formed so as to be gradually twisted and inclined in the rotational direction R as it goes from the base end side of the driving shaft 1011 which is one side (right side in FIG. 11) in the direction of the central axis C to the tip side of the driving shaft 1011 which is the other side (left side in FIG. 11), and extends in a direction which is not parallel to the central axis C.

Additionally, the length of the fins 1004 in the direction of the central axis C is set to about ⅕ to ½ of the total length of the printing plate cylinder 1010 in the direction of the central axis C. Although a metallic material, such as iron or titanium, can be used as a material for the fins 1004, the material is not limited thereto. However, it is more preferable to use a material having a high heat radiation effect.

Next, a printing apparatus 1050 for a can using the printing plate cylinder 1010 of the present invention will be described.

As shown in FIG. 13, the printing apparatus 1050 for a can has an ink adhering mechanism 1051 and a can moving mechanism 1052.

The ink adhering mechanism 1051 includes a plurality of inker units 1055 which is provided in respective colors to be printed, and a blanket wheel 1057 which transfers the ink transferred from each inker unit 1055 to the outer circumferential surface of a substantially cylindrical workpiece (can) 1056 on which a size coat film is formed.

The inker unit 1055 has an ink source 1061 which is filled with the color ink to be printed, a ducting roller 1062 which comes into contact with the ink source 1061 and receives the ink, an intermediate roller 1064 composed of a plurality of rollers which deliver the ink to a rubber roller 1063 from the ducting roller 1062, and the printing plate cylinder 1010 which comes into contact with the rubber roller 1063. Additionally, the outer circumferential surface of the printing plate cylinder 1010 is provided with the sleeve member which can be attached and detached, and the printing plate in which an image portion is formed is disposed on the outer circumferential surface of the sleeve member. Additionally, the printing plate cylinder 1010 is rotatably supported by the driving shaft 1011 of the printing apparatus 1050 for a can.

Additionally, the outer circumferential surface of the blanket wheel 1057 is provided with a plurality of blankets 1066 which come into contact with the printing plate of the printing plate cylinder 1010.

Additionally, the can moving mechanism 1052 includes a can shooter 1067 which introduces a workpiece 1056, a mandrel 1068 which rotatably holds the workpiece 1056 supplied from the can shooter 1067, and a mandrel turret 1069 which rotationally moves the workpiece 1056 mounted on the mandrel 1068 in the direction of the ink adhering mechanism 1051 sequentially.

In the printing apparatus 1050 for a can, each different color ink adheres to the printing plate mounted on the outer circumferential surface of the printing plate cylinder 1010 via the ducting roller 1062, the intermediate roller 1064, and the rubber roller 1063 from the ink source 1061 of each inker unit 1055. Then, each ink is put on the blanket 1066 on the rotating blanket wheel 1057 from the printing plate as a pattern, and this pattern is printed while coming into contact with a can body of the workpiece 1056 held by the mandrel 1068. Then, the patterns of the respective color inks overlap each other so that one pattern is printed on the can body. That is, a pattern to be printed on the can body is formed as patterns of image portions formed on the printing plate of the printing plate cylinders 1010 for respective colors overlap each other.

As described above, according to the printing plate cylinder 1010 of the present embodiment, when the printing plate cylinder 1010 rotates in the rotational direction R at the time of printing, an air stream is generated from the other side in the direction of the central axis C to one side so that the fins 1004 catches and sweeps the air of the region S with this rotation. Accordingly, after ambient air flows into the region S from the other side in the direction of the central axis C, and this ambient air is used for heat exchange with a curved surface, a flat surface or the like, which forms the region S, the ambient air is delivered from one side. That is, since the printing plate cylinder 1010 is cooled by such an air stream, the temperature of the printing plate cylinder 1010 is prevented from rising excessively even at the time of continuous operation. Hence, the temperature rise of ink to be applied to the printing plate of the outer circumferential surface of the printing plate cylinder 1010 is suppressed, ink viscosity is stabilized, and good accuracy of ink spread, color tones or the like, is maintained.

Additionally, since the direction in which the air stream flows is set to one side from the other side in the direction of the central axis C, cooled ambient air is easily drawn into the region S, and this ambient air cools the printing plate cylinder 1010 effectively, and then cools the driving shaft 1011, and the conduction of heat to the printing plate cylinder 1010 from the driving shaft 1011 which generates heat at the time of operation is suppressed. Thus, cooling efficiency is further improved.

That is, unlike the conventional technique, it is absolutely not necessary to provide a forced air-cooling device which generates cold air for cooling the printing plate cylinder 1010, or to provide an air-cooling duct for blowing off the cold air generated by the forced air-cooling device to the shaft portion 1001 of the printing plate cylinder 1010, the apparatus is simply and easily constructed, and facility cost, operation cost, and maintenance cost are reduced.

Additionally, since the CTS technique is used in the printing plate cylinder 1010 of the present embodiment, positioning of the printing plate of the printing plate cylinder 1010 can be easily performed with high accuracy, and the operation process for forming an image portion on the printing plate or replacement (attachment and detachment) of the printing plate can be simply and easily performed, so that productivity is increased. Moreover, as the printing plate cylinder 1010 using the CTS technique is effectively cooled, productivity is remarkably improved by virtue of the synergetic effect thereof.

Next, a fifth embodiment of the present invention will be described.

Figure 14:
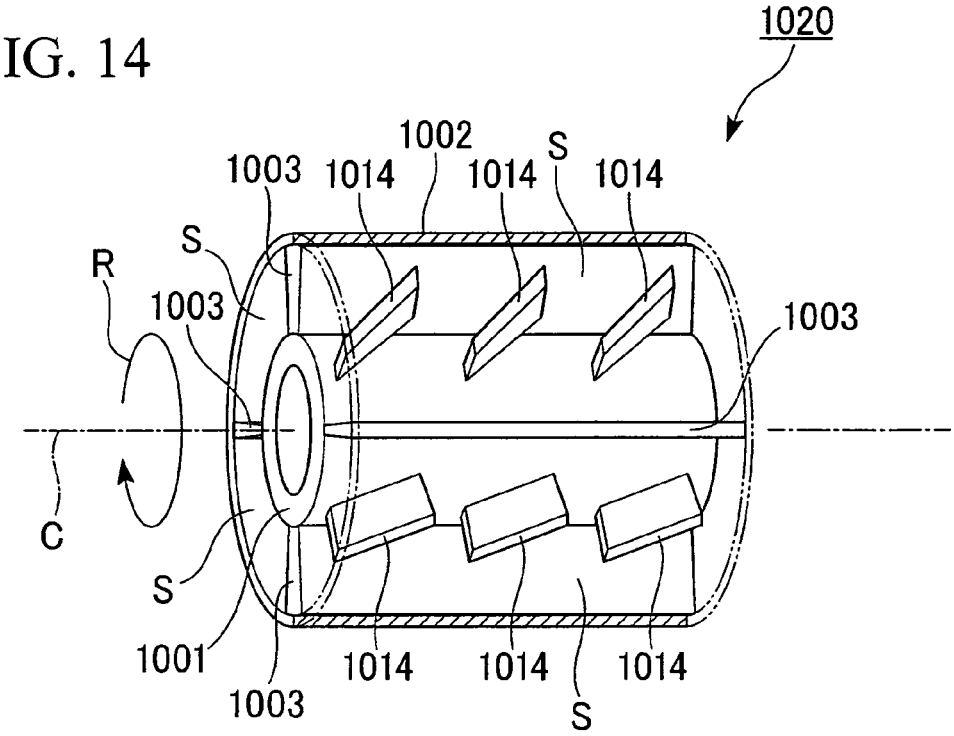
FIG. 14 is a partial transmissive perspective view showing the schematic configuration of a printing plate cylinder related to a fifth embodiment of the present invention.
Figure 15:
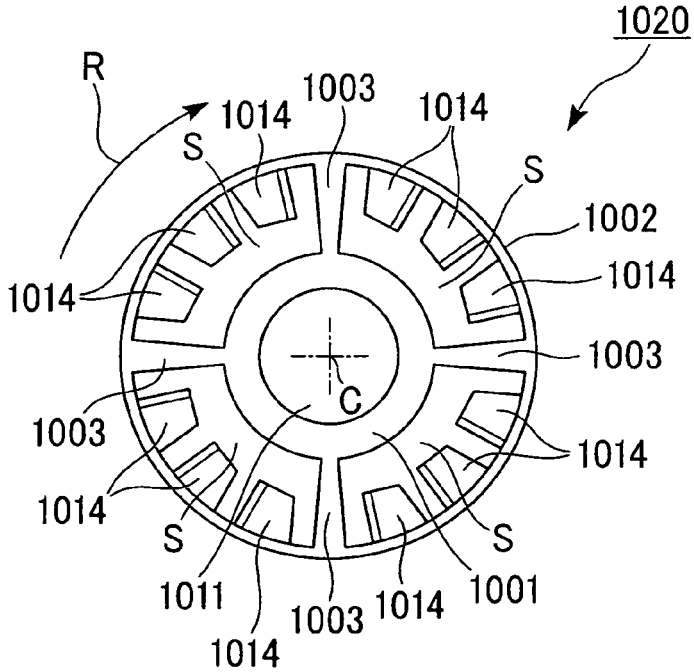
FIG. 15 is a schematic side view showing the printing plate cylinder related to the fifth embodiment of the present invention.

FIG. 14 is a partial transmissive perspective view showing the schematic configuration of a printing plate cylinder related to a fifth embodiment of the present invention, and FIG. 15 is a schematic side view showing the printing plate cylinder related to the fifth embodiment of the present invention.

In addition, the same members as those of the printing plate cylinder 1010 of the aforementioned fourth embodiment will be designated by the same reference numerals, and the description thereof will be omitted.

As shown in FIGS. 14 and 15, a plurality of substantially flat-plate-shaped fins 1014 is erected from the inner circumferential surface of the tubular portion 1002 of the printing plate cylinder 1020 of the fifth embodiment with the inner circumferential surface at base ends. As shown in FIG. 15, the fins 1014 are disposed uniformly in the circumferential direction on the inner circumferential surface of the tubular portion 1002, and the height thereof extending radially inward from the inner circumferential surface of the tubular portion 1002 are set to substantially the central portion of the region S in the radial direction. Additionally, in a state where the shaft portion 1001 and the driving shaft are fitted to each other, each fin 1014 is substantially spirally formed so as to be gradually twisted and inclined in the rotational direction R as it goes from the base end side of the driving shaft which is one side (right side in FIG. 14) in the direction of the central axis C to the tip side of the driving shaft which is the other side (left side in FIG. 14), and extends in a direction which is not parallel to the central axis C. Additionally, the length of the fins 1014 in the direction of the central axis C is set to about ⅕ to ½ of the total length of the printing plate cylinder 1020 in the direction of the central axis C.

Additionally, even in the present embodiment, a plurality of printing plate cylinders 1020, similarly to the aforementioned printing plate cylinder 1010, is disposed at the printing apparatus 1050 for a can, and is used for printing of a can.

As described above, according to the printing plate cylinder 1020 of the present embodiment, when the printing plate cylinder 1020 rotates in the rotational direction R at the time of printing, an air stream is generated from the other side in the direction of the central axis C to one side so that the fins 1014 sweep the air of the region S with this rotation. Accordingly, the same effects as the effects described in the printing plate cylinder 1010 of the aforementioned fourth embodiment can be exhibited.

Next, a sixth embodiment of the present invention will be described.

Figure 16:
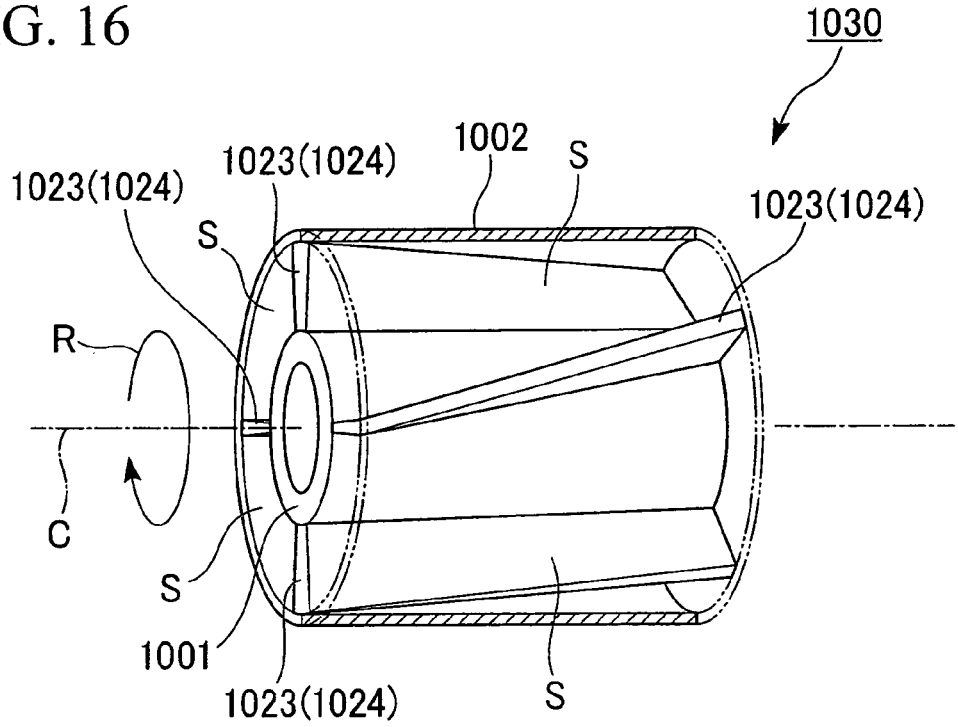
FIG. 16 is a partial transmissive perspective view showing the schematic configuration of a printing plate cylinder related to a sixth embodiment of the present invention.
Figure 17:
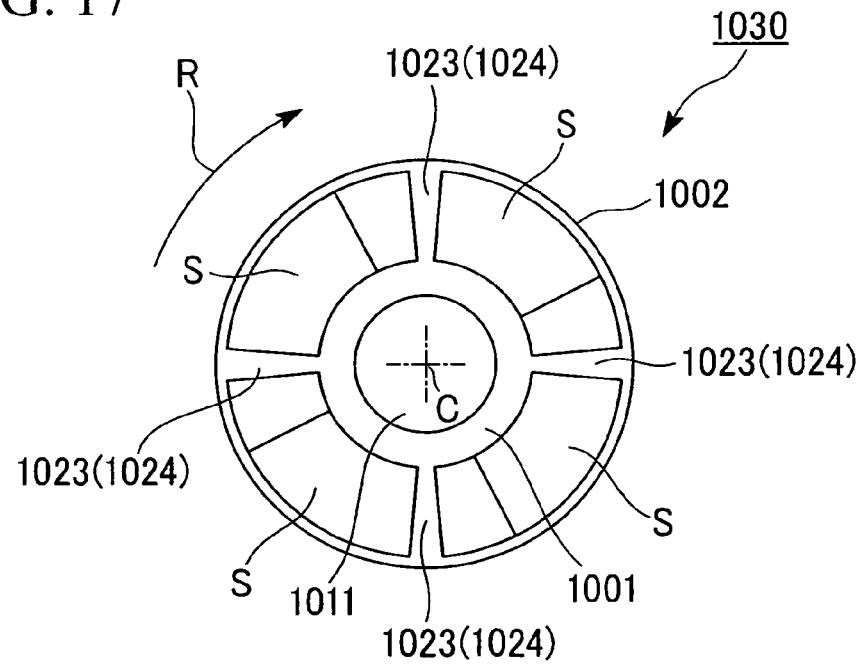
FIG. 17 is a schematic side view showing the printing plate cylinder related to the sixth embodiment of the present invention.

FIG. 16 is a partial transmissive perspective view showing the schematic configuration of a printing plate cylinder related to a sixth embodiment of the present invention, and FIG. 17 is a schematic side view showing the printing plate cylinder related to the sixth embodiment of the present invention.

In addition, the same members as those of the printing plate cylinders 1010 and 1020 of the aforementioned fourth and fifth embodiments will be designated by the same reference numerals, and a description thereof will be omitted.

As shown in FIG. 16 and FIG. 17, the printing plate cylinder 1030 of the sixth embodiment is formed to incline to the central axis C so that the inner circumferential surface of the tubular portion 1002 and the outer circumferential surface of the shaft portion 1001 are connected together, a plurality of substantially flat-plate-shaped ribs 1023 which extends in a direction which is not parallel to the central axis C is disposed uniformly in the circumferential direction, and the ribs 1023 are used as the fins 1024 for generating an air stream in the region S. That is, in a state where the shaft portion 1 and the driving shaft are fitted to each other, each rib 1023 is substantially spirally formed so as to be gradually twisted and inclined in the rotational direction R as it goes from the base end side of the driving shaft which is one side (right side in FIG. 16) in the direction of the central axis C to the tip side of the driving shaft which is the other side (left side in FIG. 16). Additionally, the length of the rib 1023 in the direction of the central axis C is set to almost the same length as the total length of the printing plate cylinder 1030 in the direction of the central axis C.

Additionally, even in the present embodiment, a plurality of printing plate cylinders 1030 is disposed at the aforementioned printing apparatus 1050 for a can, and is used for printing of a can.

As described above, according to the printing plate cylinder 1030 of the present embodiment, the ribs 1023 which connect the outer circumferential surface of the shaft portion 1001 and the inner circumferential surface of the tubular portion 1002 are used as the fins 1024 for cooling. Thus, the effect of cooling the printing plate cylinder 1030 with a simple configuration is obtained without increasing components compared to the conventional technique.

Next, a seventh embodiment of the present invention will be described.

Figure 18:
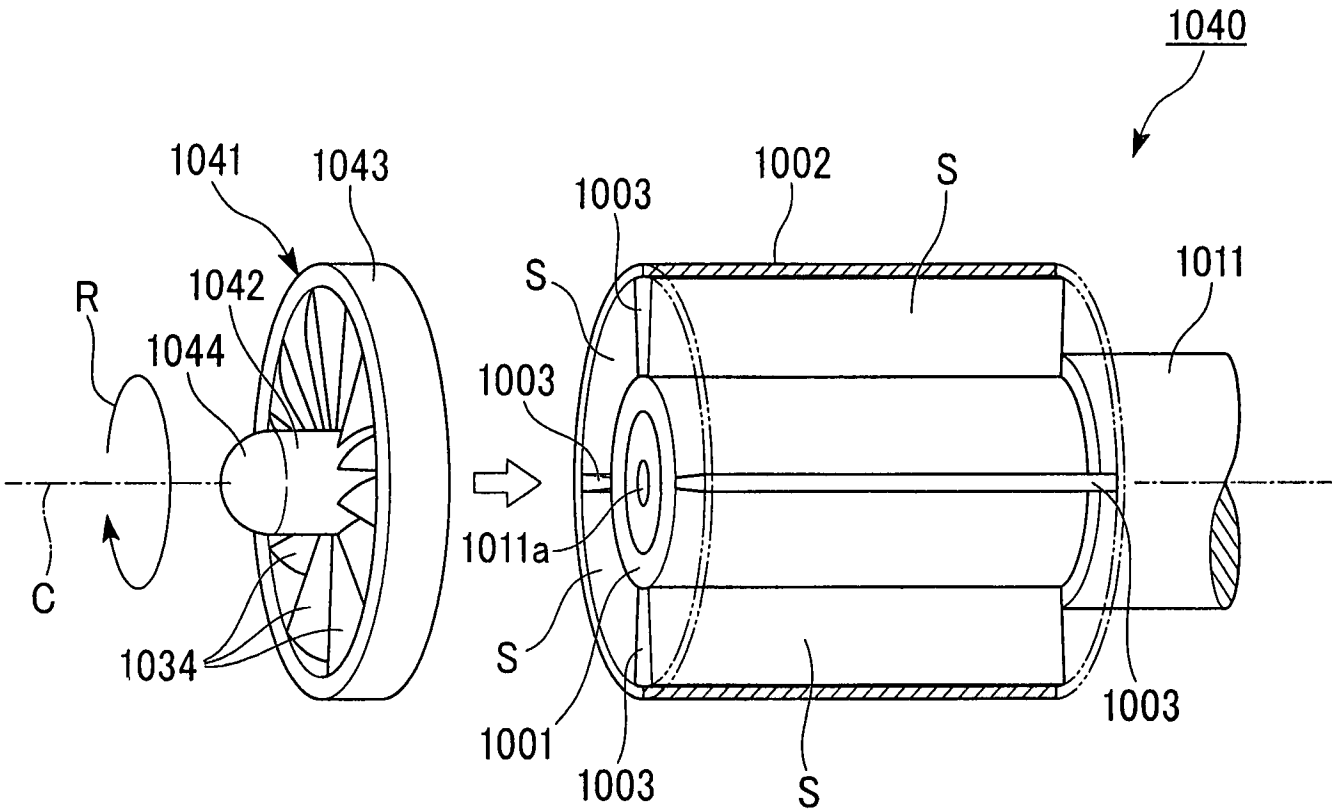
FIG. 18 is a partial transmissive perspective view showing the schematic configuration of a printing plate cylinder related to a seventh embodiment of the present invention.

FIG. 18 is a partial transmissive perspective view showing the schematic configuration of a printing plate cylinder related to the seventh embodiment of the present invention.

In addition, the same members as those of the printing plate cylinders 1010, 1020, and 1030 of the aforementioned fourth, fifth, and sixth embodiments will be designated by the same reference numerals, and a description thereof will be omitted.

As shown in FIG. 18, in a printing plate cylinder 1040 of the seventh embodiment, a substantially propeller-shaped cooling member 1041 which is formed by connecting a substantial wheel or radial outer ends of a plurality of blades to each other is coaxially and detachably disposed on the central axis C at the end of the tubular portion 1002 on the other side (left side in FIG. 18) in the direction of the central axis C. That is, the cooling member 1041 is disposed on the tip side of the driving shaft 1011 in a state where the shaft portion 1001 and the driving shaft 1011 are fitted to each other. The cooling member 1041 has a substantially cylindrical shaft portion 1042, and a substantially annular ring body 1043 coaxially disposed outside the shaft portion 1042, and is formed so as to connect the shaft portion 1042 and the ring body 1043 by a plurality of substantially flat-plate-shaped fins 1034. Additionally, the external diameter of the ring body 1043 is set to almost the same dimension as the external diameter of the tubular portion 1002.

The fins 1034 are disposed uniformly in the circumferential direction on the outer circumferential surface of the shaft portion 1042, and each fin 1034 is formed so as to be gradually twisted and inclined in the rotational direction R as it goes from one side (right side in FIG. 18) in the direction of the central axis C to the other side, and extends in a direction which is not parallel to the central axis C.

Additionally, a through hole which passes through the central axis of the shaft portion 1042 of the cooling member 1041 is set so that the internal diameter thereof on the other side is greater than the internal diameter thereof on one side, and is formed in the shape of a substantially multi-stage columnar hole. A removable snap-fitting cap 1044 which is formed in the shape of a hollow dome is disposed at end of the shaft portion 1042 on the other side. Inside the cap 1044, a male screw (not shown) which extends in the direction of the central axis C has a thread portion loosely fitted to the through hole of the shaft portion 1042, and is arranged to protrude to one side from the shaft portion 1042. Additionally, the tip face of the driving shaft 1011 on the other side is formed with a female thread hole 1011*a* which is bored and threaded in the direction of the central axis C.

The cooling member 1041 is mounted on the printing plate cylinder 1040 by screwing the male screw and the female thread hole 1011*a* together. In addition, it is preferable to use a detent pin, a screw locking agent or the like, which are not shown so that the male screw of the cooling member 1041 is prevented from loosening and idling at the time of rotation of the printing plate cylinder 1040.

Additionally, even in the present embodiment, a plurality of printing plate cylinders 1040 is disposed at the aforementioned printing apparatus 1050 for a can, and is used for printing of a can.

As described above, according to the printing plate cylinder 1040 of the present embodiment, the fins 1034 are formed on the cooling member 1041 attachable to and detachable from the end of the printing plate cylinder 1040 in the direction of the central axis C. Thus, when the printing plate cylinder 1040 has rotated in the rotational direction R, the shaft portion 1001 and the cooling member 1041 rotate integrally so that the fins 1034 of the cooling member 1041 generate an air stream from the tip side of the driving shaft 1011 on the other side to the base end side of the driving shaft 1011 on one side, in the region S between the shaft portion 1001 and the tubular portion 1002. Accordingly, in a case where the printing apparatus 1050 for a can is provided with the plurality of printing plate cylinders 1040, the number or shape of the fins 1034 of the cooling member 1041 can be set in accordance with a desired cooling temperature of each printing plate cylinder 1040, or the cooling member 1041 can be easily installed by post-installation, and it is possible to cope with various demands of cooling of the printing plate cylinders 1040 flexibly.

In addition, the present invention is not limited to the aforementioned fourth and seventh embodiments, but various modifications can be made without departing from the spirit and scope of the present invention.

For example, although descriptions have been made in the fourth to seventh embodiments that the fins are inclined with respect to the central axis C, respectively, and are formed to extend in a direction which is not parallel to the central axis C, an air stream has only to be capable of being generated in the region S, and the present invention is not limited thereto. That is, for example, a plurality of fins may be made to extend in the direction of the central axis C uniformly in the circumferential direction, and may be formed in the shape of a sirocco fan so that when a printing plate cylinder has rotated, an air stream is generated outward from the radial inside. Additionally, for example, a plurality of short fins may be formed parallel to the central axis C, and these fins may be lined up so as to be arranged in a staircase pattern gradually toward the rotational direction R as they go from one side in the direction of the central axis C toward the other side.

Additionally, although a description has been made in the fourth embodiment that the fins 1004 are erected from the outer circumferential surface of the shaft portion 1001 and a description has been made in the fifth embodiment that the fins 1014 are erected from the inner circumferential surface of the tubular portion 1002, both of the fins 1004 and 1014 may be erected. Additionally, a printing plate cylinder may be formed such that the ribs 1023 (fins 1024) of the sixth embodiment or the fins 1034 of the fourth embodiment are mixed.

Additionally, the radial height of the fins, the length of the fins in the direction of the central axis C, or the number or shape of the fins are not limited to the present embodiment.

Additionally, although descriptions have been made in the fourth to seventh embodiments that the fins are formed so as to incline gradually in the rotational direction R as they go from the one side in the direction of the central axis C toward the other side, and an air stream which is generated as the printing plate cylinder rotates flows toward the one side from the other side, the fins may be formed so as to incline gradually in the rotational direction R as they go from the other side in the direction of the central axis C toward one side, and an air stream which is generated as the printing plate cylinder rotates flows toward the other side from the one side.

Otherwise, a plurality of fins with different inclinations may be alternately lined up, and turbulence may be generated in the region S to cool a printing plate cylinder.

Additionally, the fins (ribs) have only to be disposed so as to generate an air stream in the region S with the rotation of the shaft portion 1001. For example, fins may be formed in the shape of a flat plate which extends parallel to the direction of the central axis C.

Additionally, although a description has been made in the seventh embodiment that the cooling member 1041 is detachably disposed on the tip side of the driving shaft 1011 in the direction of the central axis C of the printing plate cylinder 1040, the present invention is not limited thereto. The cooling member may be detachably disposed on the base end side of the driving shaft 1011.

Additionally, although descriptions have been made in the fourth to seventh embodiments that the shaft portion 1001 of the printing plate cylinder is formed cylindrically, the present invention is not limited thereto. That is, the shaft portion may have a substantial columnar shape, a substantially tapered shape, or other shapes.

Additionally, although descriptions have been made in the fourth to seventh embodiments that the kind of the printing is relief printing, the kind of printing is not limited thereto. That is, for example, when the present invention used for a waterless planographic plate, the temperature rise of the printing plate cylinder is suppressed, deterioration of the printing plate is prevented, and it is possible to perform stable printing over a long period of time.

Additionally, although descriptions have been made in the fourth to seventh embodiments that the sleeve member attachable to and detachable from the outer circumferential surface of the printing plate cylinder is provided, and the printing plate is disposed on the outer circumferential surface of the sleeve member, the present invention is not limited thereto. That is, instead of using the sleeve member, for example, a configuration may be adopted in which a plate-shaped printing plate is directly clamped and detachably fixed to the outer circumferential surface of a printing plate cylinder.

Additionally, the fourth to seventh embodiments can be made to exist with the first to third embodiments. For example, fins which generate an air stream at a gap between the outer circumferential surface of a shaft portion, and a tubular portion can also be disposed at a printing plate cylinder which is constructed to mount a sleeve printing plate with an increased diameter by blown off air from air outlet holes through an air supply passage.

Figure 19:
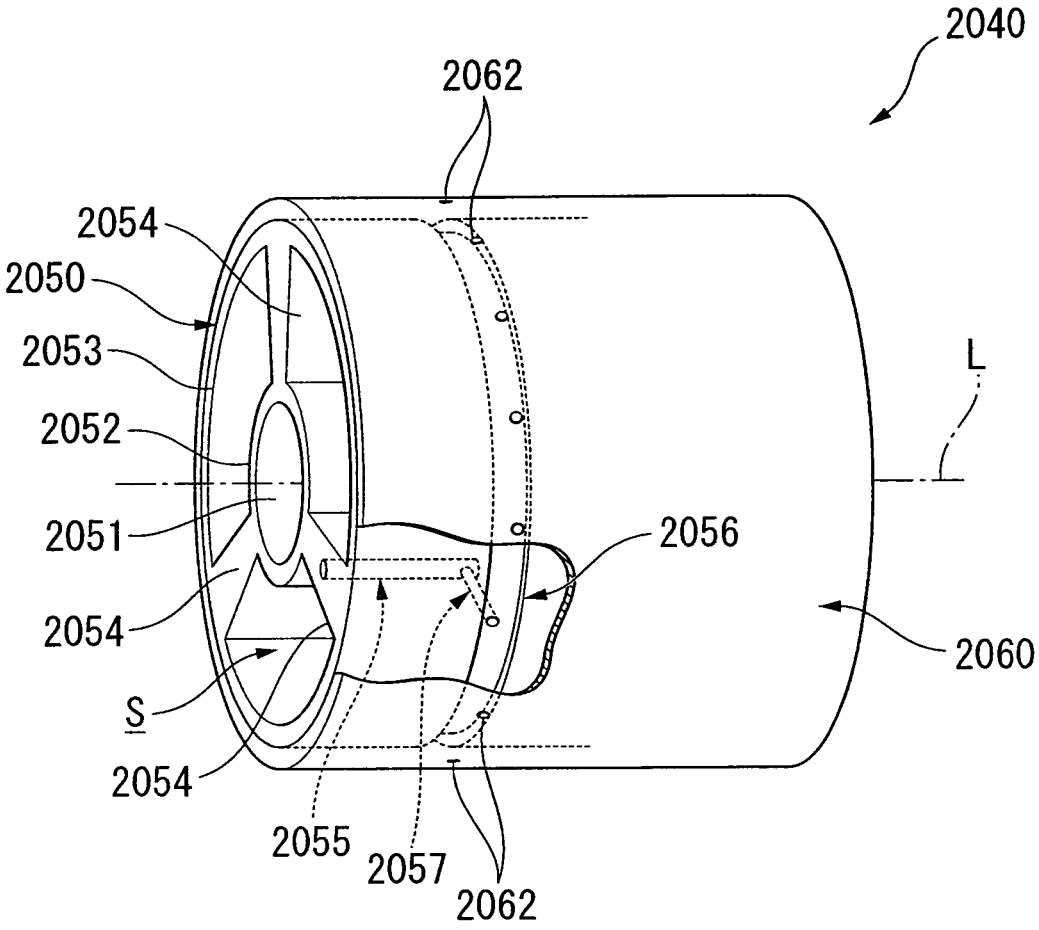
FIG. 19 is a schematic perspective view showing a printing plate cylinder related to an eighth embodiment of the present invention.
Figure 20:
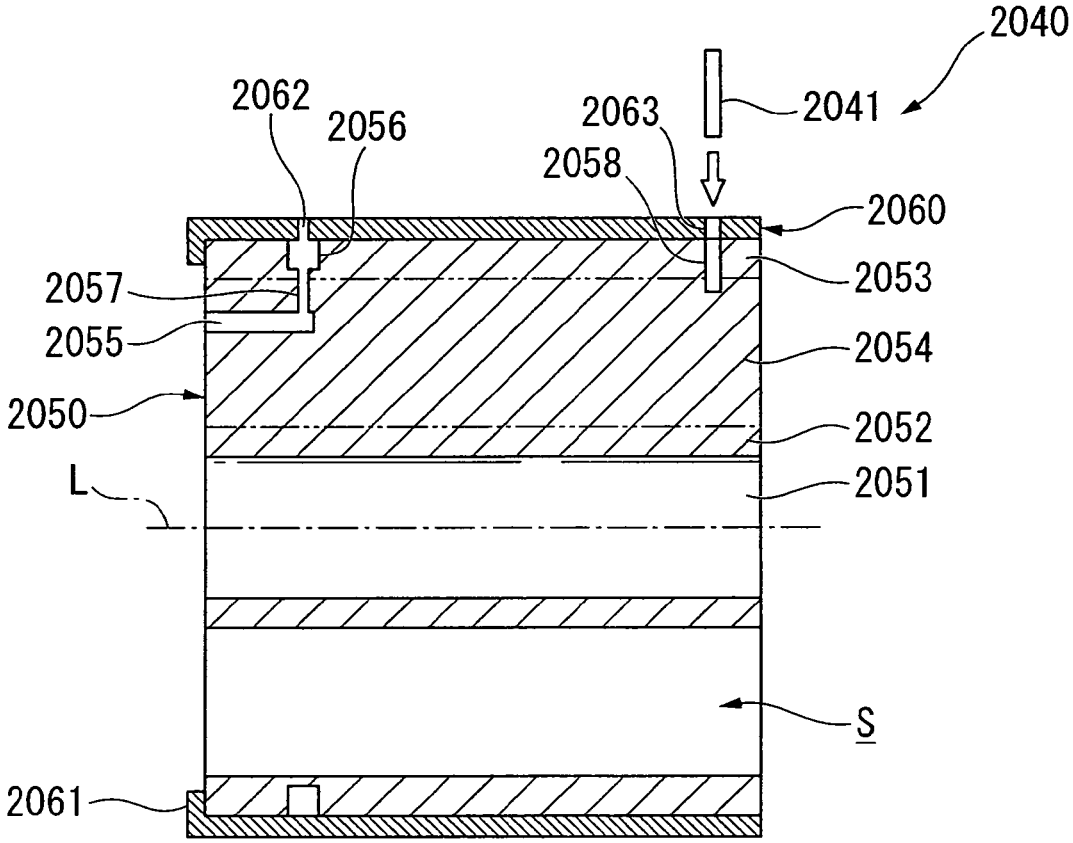
FIG. 20 is a schematic side sectional view of the printing plate cylinder of FIG. 19.
Figure 21:
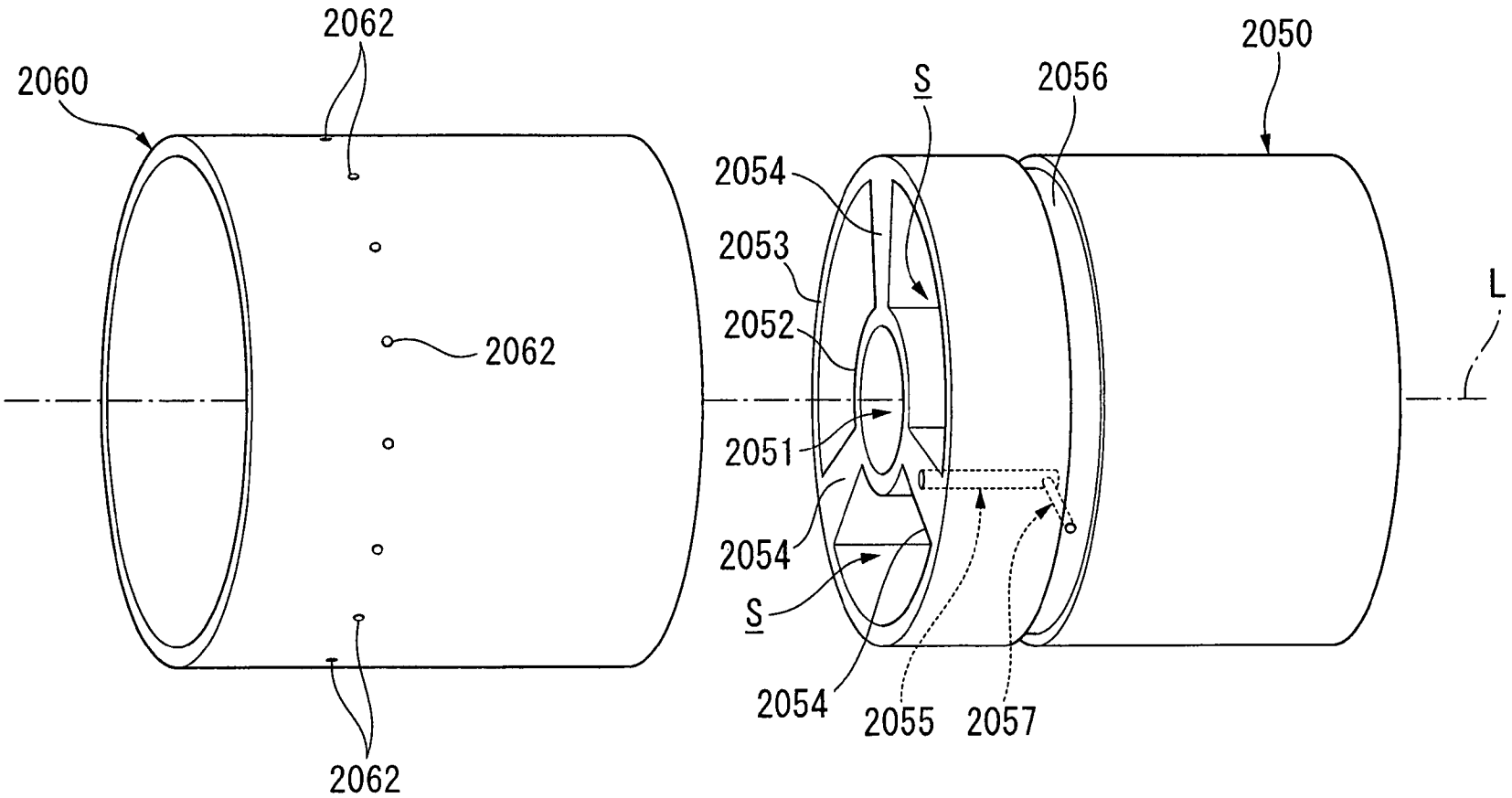
FIG. 21 is a schematic perspective view showing a state where the printing plate cylinder of FIG. 19 is separated into a core member and a sleeve member.

Hereinafter, a printing plate cylinder related to the eighth embodiment of the present invention will be described. A printing plate cylinder 2040 which is the present embodiment supports a sleeve printing plate 2030 which forms a cylindrical shape in close contact. As shown in FIGS. 19 to 21, the printing plate cylinder 2040 has a substantially columnar appearance which extends in the direction of an axis L, and includes a core member 2050 which is located on the inner circumferential side, and a sleeve member 2060 which forms a cylindrical shape and is coaxially arranged on the outer circumferential side of the core member 2050.

The core member 2050 has an inside tubular portion 2052 which has a fitting hole 2051 which penetrates in the direction of the axis L, an outside tubular portion 2053 arranged at a distance from the outer circumferential surface of the inside tubular portion 2052, and a plurality of (three in the illustrated example) ribs 2054 which extends in the radial direction and connects the inside tubular portion 2052 and the outside tubular portion 2053 integrally.

A rotary shaft 2006 of a printing apparatus is fitted through the fitting hole 2051 provided in the inside tubular portion 2052, and the printing plate cylinder 2040 is detachably mounted on the printing apparatus. In a state of being fixed to the rotary shaft 2006, the torque of the rotary shaft 2006 is transmitted to the core member 2050 so that the printing plate cylinder 2040 is rotated about the axis L.

The rib 2054 is formed substantially in the shape of a plate which is made narrow in the circumferential direction of the inside tubular portion 2052 or the outside tubular portion 2053, and is formed so as to extend from the outer circumferential surface of the inside tubular portion 2052 to the inner circumferential surface of the outside tubular portion 2053, and extend along the direction of the axis L. Specifically, each rib 2054 has one end located inside in the radial direction integrally fixed to the outer circumferential surface of the inside tubular portion 2052, and the other end integrally fixed to the inner circumferential surface of the outside tubular portion 2053. A plurality of ribs 2054 is arranged at equal intervals in the circumferential direction of the core member 2050. Accordingly, in the printing plate cylinder 2040, a gap region S which is opened to the outside from both ends in the direction of the axis L is defined by the above-described ribs 2054, inside tubular portion 2052 and outside tubular portion 2053.

One of the plurality of ribs 2054 is provided with an air supply passage 2055 which extends in the direction of the axis L from an end face (outer surface) in the direction of the axis L.

Additionally, an annular groove 2056 which is dented in the radial direction is formed in a portion in the direction of axis L in the outer circumferential surface of the outside tubular portion 2053. An air connecting passage 2057 which communicates with the aforementioned air supply passage 2055 and extends radially outward is open to the bottom of the annular groove 2056.

The sleeve member 2060 is fitted to the outer circumferential side of the core member 2050, and as shown in FIGS. 20 and 22, has one end in the direction of the axis L formed with a locking portion 2061 which protrudes toward the inner circumferential side.

When the core member 2050 is press-fitted into the sleeve member 2060, the locking portion 2061 abuts on the end face of the core member 2050 in the direction of the axis L, and plays a role in positioning the position of the sleeve member 2060 in the direction of the axis L with respect to the core member 2050. In addition, the locking portion 2061 is set so that the internal diameter thereof is greater than the internal diameter of the inner circumferential surface of the core member 2050, and does not protrude further inward than the inner circumferential surface of the core member 2050 in a press-fitted state.

Additionally, the sleeve member 2060 is formed with a plurality of air outlet holes 2062 which penetrates in the thickness direction (the radial direction) of the sleeve member, and the plurality of air outlet holes 2062 is arrayed at equal intervals in the circumferential direction of the sleeve member 2060.

The plurality of air outlet holes 2062 are arranged on (radially outside) the annular groove 2056 of the core member 2050 in a state where the core member 2050 is press-fitted into the sleeve member 2060, and the air outlet holes communicate with the air connecting passage 2057 and the air supply passage 2055 via the annular groove 2056.

Figure 22:
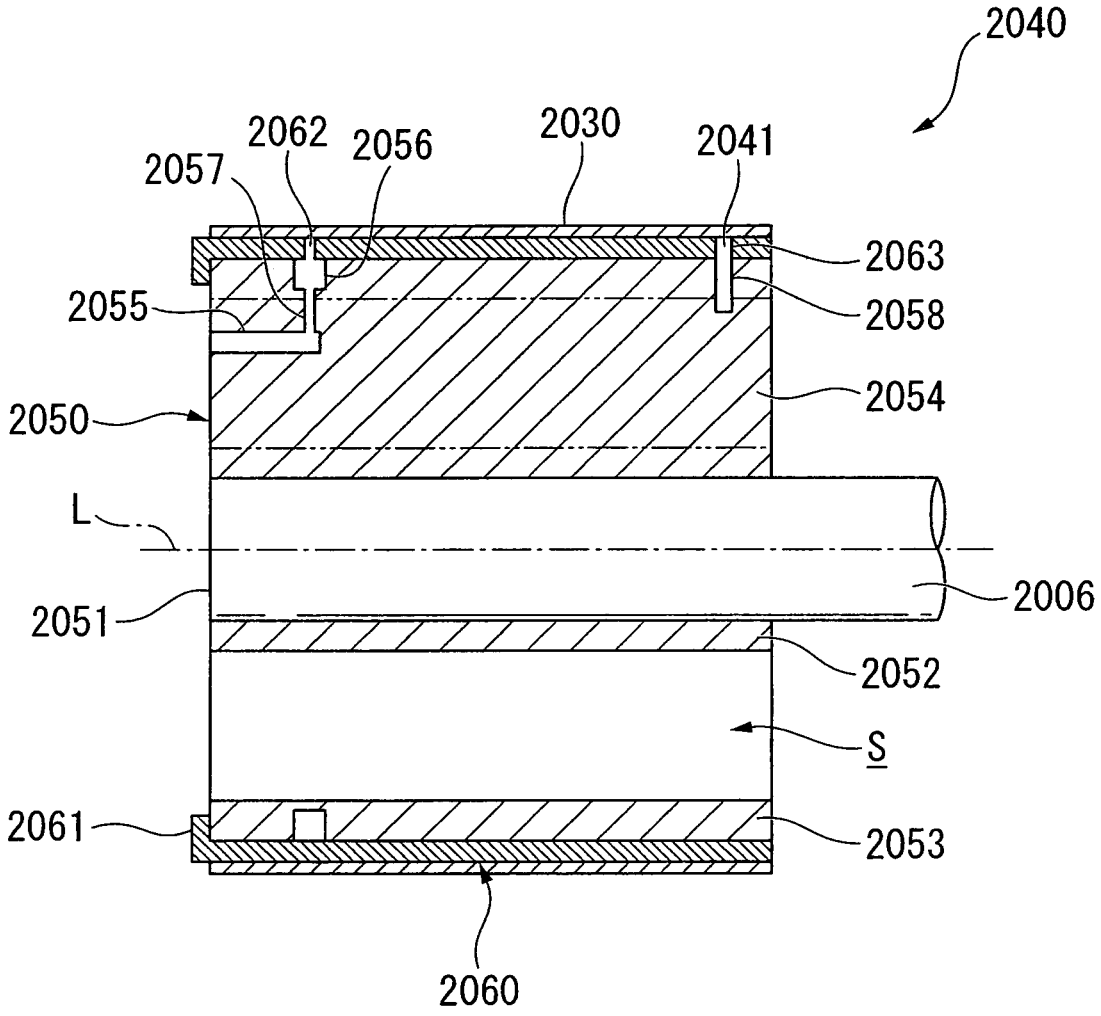
FIG. 22 is a schematic side sectional view showing a state where a rotary shaft and a sleeve printing plate are fixed to the printing plate cylinder of FIG. 19.

In addition, in the illustrated example, the annular groove 2056 and the plurality of air outlet holes 2062 are arranged closer to one end of the printing plate cylinder 2040 in the direction of the axis L. However, the annular groove and the plurality of air outlet holes may be arranged to, for example, an intermediate position in the direction of the axis L. In a case where the annular groove 2056 and the plurality of air outlet holes 2062 are arranged closer to the one end in the direction of the axis L as in the illustrated example, as shown in FIG. 22, it is preferable to form the printing plate cylinder 2040 so that the rotary shaft 2006 is inserted from the other end of the printing plate cylinder 2040 in the direction of the axis L.

The core member 2050 and the sleeve member 2060 are respectively formed with a bottomed hole 2058 and a through hole 2063 for positioning the relative circumferential positions thereof. That is, the core member 2050 is formed with the bottomed hole 2058 depressed from the outer circumferential surface of the core member 2050, and the sleeve member 2060 is formed with the through hole 2063 which penetrates in the thickness direction thereof. In a state where the sleeve member 2060 is mounted on the core member 2050, the axial positions of the bottomed hole 2058 and the through hole 2063 coincide with each other.

Accordingly, in this state, by adjusting the relative circumferential positions of the core member 2050 and the sleeve member 2060 so that the bottomed hole 2058 and the through hole 2063 communicate with each other, and inserting a locating pin 2041 into the bottomed hole 2058 and the through hole 2063, the relative circumferential positions of the core member 2050 and the sleeve member 2060 can be positioned.

In the present embodiment, the core member 2050 and the sleeve member 2060 are formed from mutually different materials. Specifically, the core member 2050 is formed from carbon steel having good workability, and the sleeve member 2060 is formed from stainless steel having excellent corrosion resistance and rigidity.

Next, a method for producing the printing plate cylinder 2040 constructed as mentioned above will be described.

When the printing plate cylinder 2040 which is the present embodiment is produced, first, a columnar member (not shown) made of carbon steel is hollowed out in the axial direction L, and the inside tubular portion 2052, the ribs 2054, and the outside tubular portion 2053 are integrally molded. That is, the hollowed-out portion of the columnar member becomes the fitting hole 2051 or the gap region S, and thereby, the core member 2050 is produced. In addition, although the hollowing out of the columnar member can be performed by various working methods, it is more preferable that the hollowing out be performed by machining, such as wire cutting work, or cutting work. At this time, since the rotary shaft 2006 of the printing apparatus is fitted into the fitting hole 2051, high dimensional accuracy is required.

Additionally, the annular groove 2056 is formed in the outer circumferential surface of the columnar member by cutting work, etc. Additionally, the air supply passage 2055 is formed in the rib 2054, the air connecting passage 2057 is bored in the bottom of the annular groove 2056, and the air supply passages 2055 and the air connecting passage 2057 communicate with each other.

The sleeve member 2060 is shaped by cutting a ring-shaped raw material made of stainless steel with predetermined dimensions, and boring the plurality of air outlet holes 2062. In addition, it is not necessary to perform plating treatment on the outer circumferential surface of the sleeve member 2060.

The bottomed hole 2058 and the through hole 2063 are bored after the core member 2050 is press-fitted to the inner circumferential side of the sleeve member 2060, and the locking portion 2061 of the sleeve member 2060 is adjusted in the position in the direction of the axis L so as to abut on the end face of the core member 2050. The locating pin 2041 is inserted into the bottomed hole 2058 and the through hole 2063. The printing plate cylinder 2040 which is the present embodiment is produced in this way.

Figure 23:
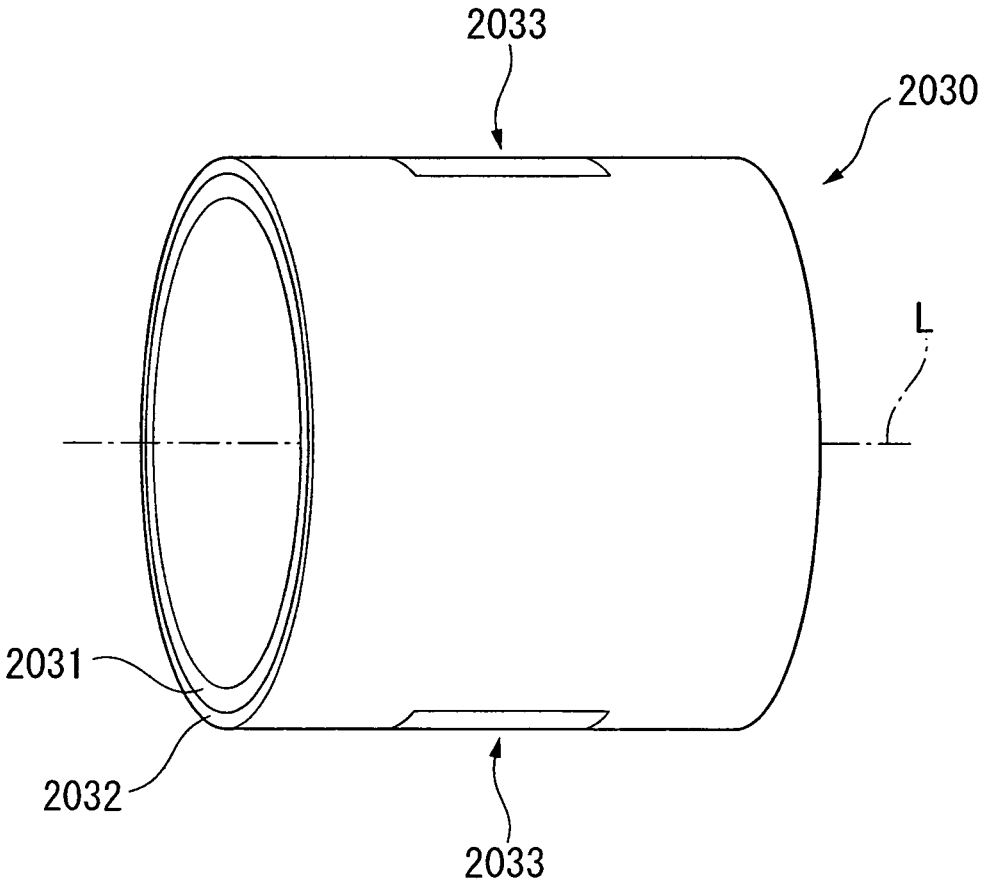
FIG. 23 is a perspective view of a sleeve printing plate which is mounted on the printing plate cylinder shown in FIG. 19.
Figure 24:
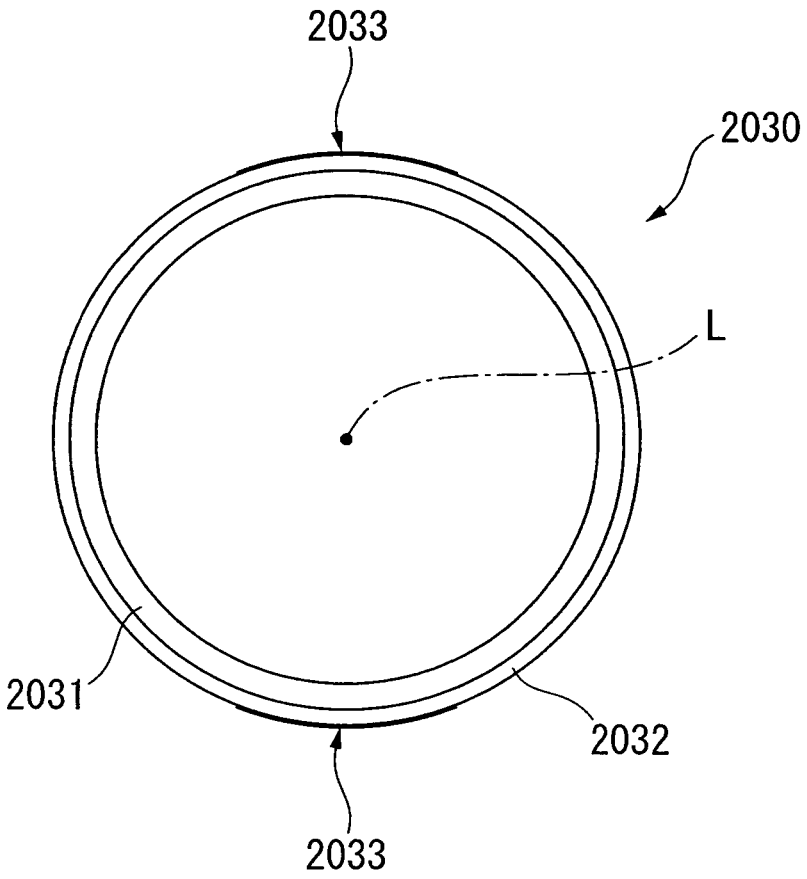
FIG. 24 is a view when the sleeve printing plate of FIG. 23 is observed from the direction of an axis.

Next, the sleeve printing plate 2030 which is mounted on the printing plate cylinder 2040 which is the present embodiment will be described. The sleeve printing plate 2030 to be used in the present embodiment, as shown in FIGS. 23 and 24, includes a sleeve support 2031 which forms a cylindrical shape extending along the axis L, and a block member 2032 which is disposed on the outer circumferential side of the sleeve support 2031.

The block member 2032 is made of, for example, photosensitive resin which allows carving by a laser beam, and forms a cylindrical shape whose thickness is 0.5 mm to 1.0 mm. The block member 2032 is shaped integrally with the sleeve support 2031 by applying and hardening melting resin on the outer circumferential surface of the sleeve support 2031. A relief printing plate 2033 (plate body) which has an image pattern by etching or laser beam machining is formed. In addition, in the present embodiment, two relief printing plate 2033 and 2033 are disposed at positions which face each other with the axis L therebetween.

The sleeve support 2031 is formed from fiber reinforced plastic (FRP) or polyethylene terephthalate (PET) resin, and the thickness thereof is 0.1 mm to 0.5 mm.

The whole thickness of the sleeve printing plate 2030 is set to 0.6 mm to 1.5 mm, and the internal diameter of the sleeve printing plate is set to be slightly smaller than the external diameter of the printing plate cylinder 2040.

Next, a method for mounting the sleeve printing plate 2030 to the printing plate cylinder 2040 will be described.

When the sleeve printing plate 2030 is mounted on the printing plate cylinder 2040, a portion of the sleeve printing plate 2030 is first inserted into one end of the printing plate cylinder 2040. In this state, high-pressure air is supplied to the air supply passage 2055 open to the end face of the rib 2054 in the direction of the axis L. Then, air is supplied into the annular groove 2056 and spreads in the circumferential direction through the air supply passage 2055 and the air connecting passage 2057. Then, high-pressure air is blown off through the air outlet holes 2062 open to the outer circumferential surface of the sleeve member 2060.

In a state where the sleeve printing plate 2030 is increased in diameter by the high-pressure air blown off through the air outlet holes 2062, the sleeve printing plate 2030 is moved in the direction of the axis L. By stopping supply of high-pressure air after the position of the sleeve printing plate 2030 in the direction of the axis L, and the circumferential position of the sleeve printing plate are adjusted, the sleeve printing plate 2030 returns to an original internal diameter, and the sleeve printing plate 2030 is mounted on the cylindrical surface of the printing plate cylinder 2040.

Figure 25:
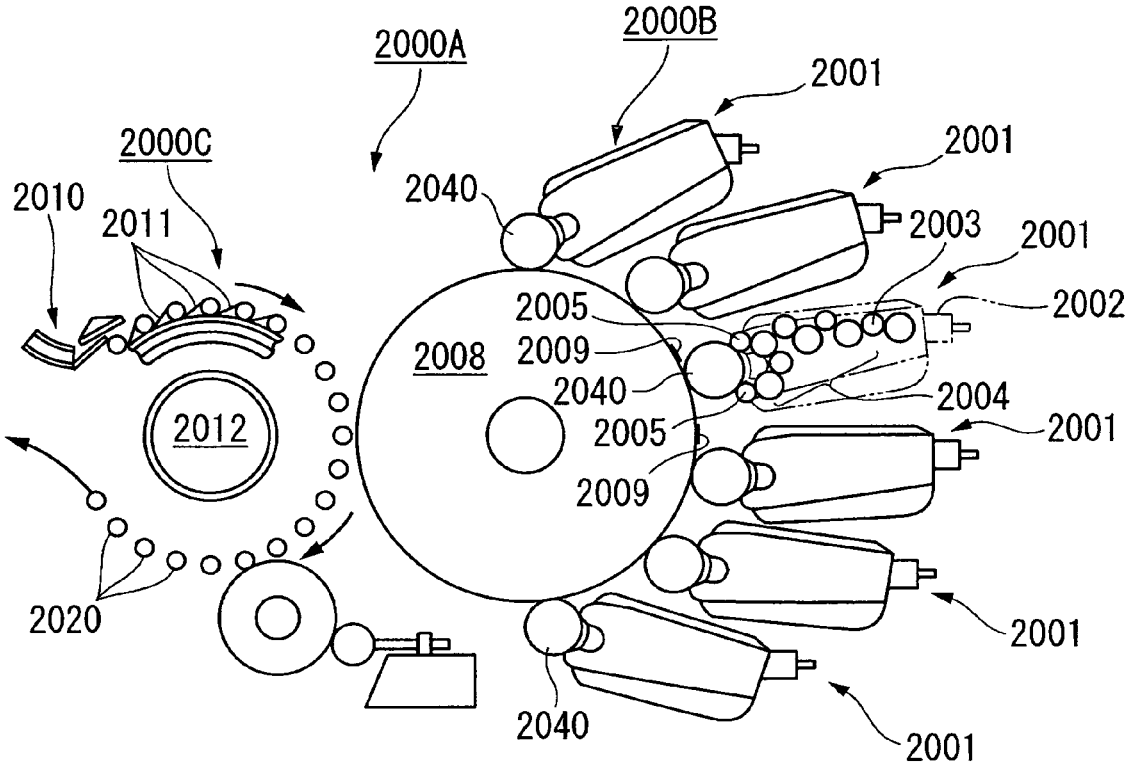
FIG. 25 is a schematic view showing a printing apparatus for a can using the printing plate cylinder of FIG. 19.

Next, an offset printing apparatus 2000A including the printing plate cylinder 2040 which is the present embodiment will be described. The offset printing apparatus 2000A which is the present embodiment is a printing apparatus for a can which performs printing on the outer circumferential surface of a can body which forms a cylindrical shape. The outline of the offset printing apparatus 2000A is shown in FIG. 25.

The offset printing apparatus 2000A is substantially composed of a plurality of arranged ink adhering mechanisms 2000B, and a can moving mechanism 2000C.

Each ink adhering mechanism 2000B is composed of an inker unit 2001 which supplies ink, and a blanket wheel 2008 including a plurality of blankets 2009 which comes into contact with the inker unit 2001 and transfers ink, and then prints (adheres) this ink, after coming into contact with the outer circumferential surface of a can barrel 2020.

The inker unit 2001 is composed of an ink source 2002, a ducting roll 2003 which comes into contact with the ink source 2002, and receives ink, an intermediate roller 2004 which is connected to the ducting roll 2003 and is composed of a plurality of rollers, a rubber roller 2005 which is connected to the intermediate roller 2004, and a printing plate cylinder 2040 which is connected to the rubber roller 2005, and the sleeve printing plate 2030 including the relief printing plate 2033 having an image pattern to be transferred to the can barrel 2020 is disposed on the outer circumferential surface of the printing plate cylinder 2040. The outer circumferential surface of the blanket wheel 2008 is provided with the plurality of blankets 2009, and each blanket 2009 is constructed so as to come into contact with the relief printing plate 2033 of the sleeve printing plate 2030 disposed on the outer circumferential surface of the printing plate cylinder 2040, and come into contact with the can barrel 2020.

The can moving mechanism 2000C includes a can shooter 2010 which introduces the can barrel 2020, a mandrel 2011 which rotatably holds the can barrel 2020 supplied from the can shooter 2010, and a mandrel turret 2012 which rotationally moves the mandrel 2020 mounted on the mandrel 2011 in the direction of the ink adhering mechanism 2000B sequentially.

In the offset printing apparatus 2000A, a different color ink from the ink source 2002 of each inker unit 2001 is made to adhere to the relief printing plate 2033 disposed on the outer circumferential surface of the printing plate cylinder 2040, via the ducting roll 2003, the intermediate roller 2004, and the rubber roller 2005, each ink is put on the blanket 2009 on the rotating blanket wheel 2008 as a pattern, and this pattern is printed while coming into contact with the can barrel 2020 held by the mandrel 2011.

The printing plate cylinder 2040 which is the present embodiment is used in this way.

According to the printing plate cylinder 2040 which is the present embodiment constructed as described above, the core member 2050 which has the fitting hole 2051 into which the rotary shaft 2006 is fitted, and the sleeve member 2060 on which the sleeve printing plate 2030 is mounted are separately formed, and the core member 2050 and the sleeve member 2060 are made of mutually different materials. Thus, it is possible to appropriately select the materials of the core member 2050 and the sleeve member 2060 depending on the required characteristics.

In the present embodiment, the core member 2050 is made of carbon steel having good workability. Thus, the fitting hole 2051 into which the rotary shaft 2006 of the printing apparatus is fitted can be shaped with high dimensional accuracy, and it is possible to smoothly perform attachment and detachment of the printing plate cylinder 2040. Particularly, in the present embodiment, the core member 2050 is provided with the gap region S, the air supply passage 2055, the air connecting passage 2057, and the annular groove 2056. Thus, it is possible to shape these portions easily with high dimensional accuracy by using carbon steel having good workability. Additionally, since the gap region S is formed, it is possible to reduce the weight of the printing plate cylinder 2040.

Additionally, since the sleeve member 2060 on which the sleeve printing plate 2030 is mounted is made of stainless steel having excellent corrosion resistance and rigidity, it is possible to suppress generation of rust without performing plating treatment on the cylindrical surface of the sleeve member 2060. Moreover, since the rigidity of the cylindrical surface is improved, printing can be stably performed.

According to the offset printing apparatus 2000A including this printing plate cylinder 2040, by mounting the lightweight printing plate cylinder 2040 on the rotary shaft 2006, rotational operation can be stabilized, occurrence of printing unevenness at the time of printing can be suppressed, and the yield of cans can be improved.

Additionally, since generation of rust in the printing plate cylinder 2040 can also be suppressed, it is possible to use the same printing plate cylinder 2040 over a long period of time without replacement, and it is consequently possible to reduce the running cost of the offset printing apparatus 2000A.

Figure 26:
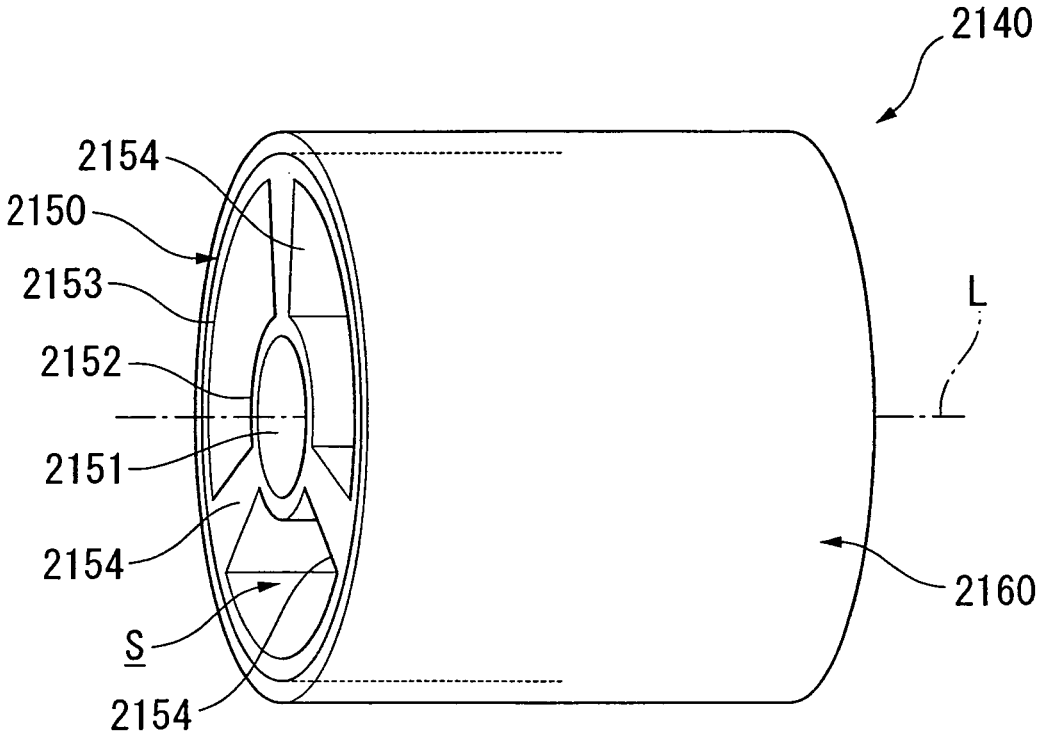
FIG. 26 is a schematic perspective view showing a printing plate cylinder related to a ninth embodiment of the present invention.

Next, a printing plate cylinder which is a ninth embodiment of the present invention will be described. As shown in FIG. 26, a printing plate cylinder 2140 which is the present embodiment has a substantially columnar appearance which extends in the direction of an axis L, and includes a core member 2150 which is located on the inner circumferential side, and a sleeve member 2160 which forms a cylindrical shape and is coaxially arranged on the outer circumferential side of the core member 2150.

In the present embodiment, the core member 2150 is made of stainless steel, and the sleeve member 2160 is made of a resin material.

The core member 2150, similarly to the eighth embodiment, has an inside tubular portion 2152 which has a fitting hole 2151 penetrating it in the direction of the axis L, an outside tubular portion 2153 arranged at a distance from the outer circumferential surface of the inside tubular portion 2152, and a plurality of (three in the illustrated example) ribs 2154 which extends in the radial direction and connects the inside tubular portion 2152 and the outside tubular portion 2153 integrally.

A resin material which forms the sleeve member 2160 is made of, for example, polyetheretherketone resin (so-called PEEK resin), is lightweight, and has a lower heat conductivity compared to carbon steel.

The internal diameter of this sleeve member 2160 is set to be smaller than the external diameter of the core member 2150, in a state where the core member 2150 is not press-fitted. Hence, since the sleeve member 2160 is increased in diameter in a state where the core member 2150 is press-fitted, the tensile stress in the circumferential direction is loaded.

According to the printing plate cylinder 2140 of this configuration, since the core member 2150 is made of stainless steel, it is possible to suppress generation of rust in the core member 2150. That is, generation of rust in the fitting hole 2151 can also be prevented. Thereby, insertion or removal of the rotary shaft 2006 of the offset printing apparatus 2000A can be smoothly performed.

Additionally, since the sleeve member 2160 is made of a resin material, it is possible to further reduce the weight of the printing plate cylinder 2140. Additionally, since there is no possibility that rust may be generated even in the sleeve member 2160, the printing plate can be disposed with high accuracy on the cylindrical surface of the printing plate cylinder 2140. Additionally, since the heat conductivity of the sleeve member 2160 is low, it is possible to suppress conduction of heat generated from a driving unit of the offset printing apparatus 2000A, and stable printing can be performed over a long period of time.

Figure 27:
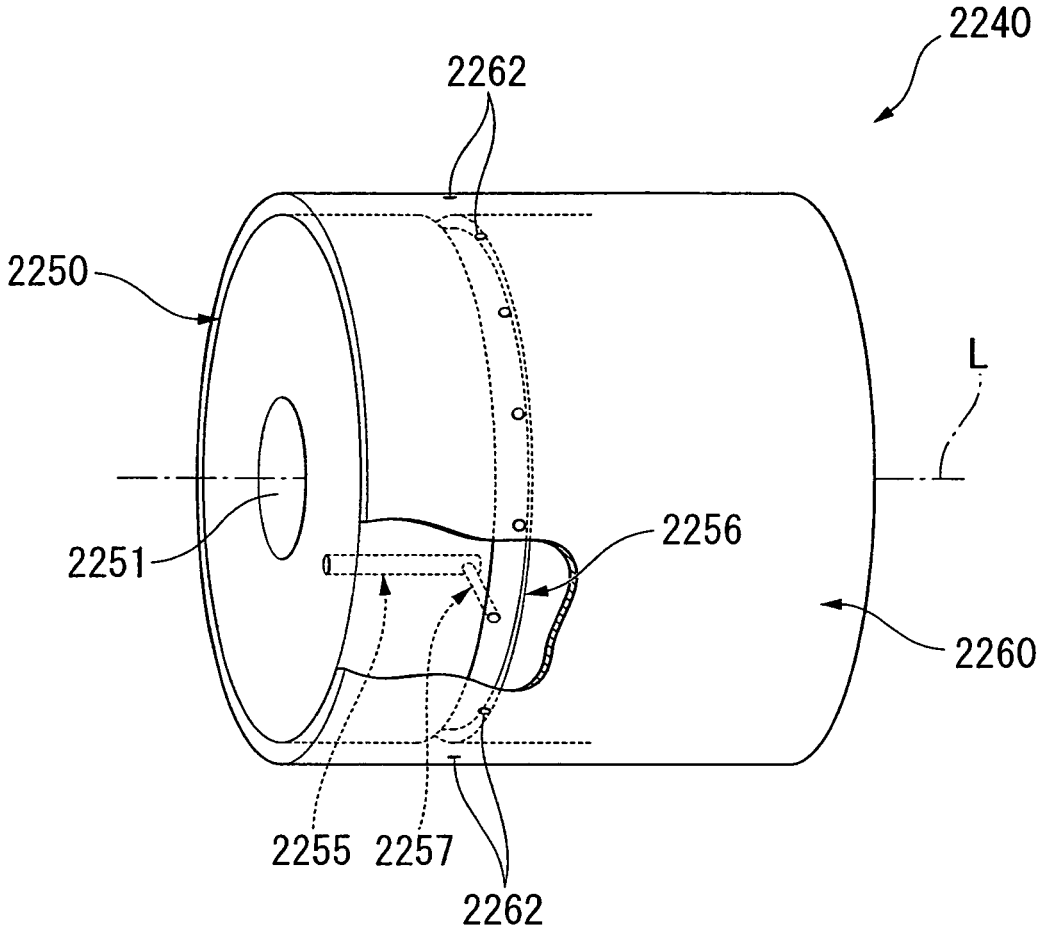
FIG. 27 is a schematic perspective view showing a printing plate cylinder related to a tenth embodiment of the present invention.

Next, a printing plate cylinder which is a tenth embodiment of the present invention will be described. As shown in FIG. 27, a printing plate cylinder 2240 which is the present embodiment has a substantially columnar appearance which extends in the direction of an axis L, and includes a core member 2250 which is located on the inner circumferential side, and a sleeve member 2260 which forms a cylindrical shape and is coaxially arranged on the outer circumferential side of the core member 2250.

In the present embodiment, the core member 2250 is made of a resin material, and the sleeve member 2260 is made of stainless steel.

Unlike the eighth embodiment or the ninth embodiment, in the core member 2250, the gap region S is not formed, and only a fitting hole 2251 which penetrates in the direction of the axis L is formed. A resin material which forms the core member 2250 is made of, for example, polyetheretherketone resin (so-called PEEK resin), is lightweight, and has a lower heat conductivity compared to carbon steel.

The core member 2250 is press-fitted to the inner circumferential side of the sleeve member 2260 made of stainless steel, and constitutes the printing plate cylinder 2240 which is the present embodiment.

According to the printing plate cylinder 2240 of this configuration, since the core member 2250 which occupies most of the printing plate cylinder 2240 is made of a resin material, it is possible to significantly reduce the weight of the printing plate cylinder 2240. Additionally, generation of rust in the core member 2250 can be suppressed, and insertion or removal of the rotary shaft 2006 of the offset printing apparatus 2000A can be smoothly performed. Moreover, since the heat conductivity of the core member 2250 is low, it is possible to suppress conduction of heat generated from a driving unit of the offset printing apparatus 2000A, and stable printing can be performed over a long period of time.

Additionally, since the sleeve member 2260 is made of stainless steel having excellent corrosion resistance, there is no possibility that rust may be generated on the cylindrical surface. Moreover, since the rigidity of the cylindrical surface of the printing plate cylinder 2240 is improved, printing can be stably performed. Moreover, since the rigidity of the sleeve member 2260 is high, deformation is suppressed by the sleeve member 2260 even if the core member 2250 made of a resin material tends to expand thermally, and stable printing can be performed over a long period of time.

Figure 28:
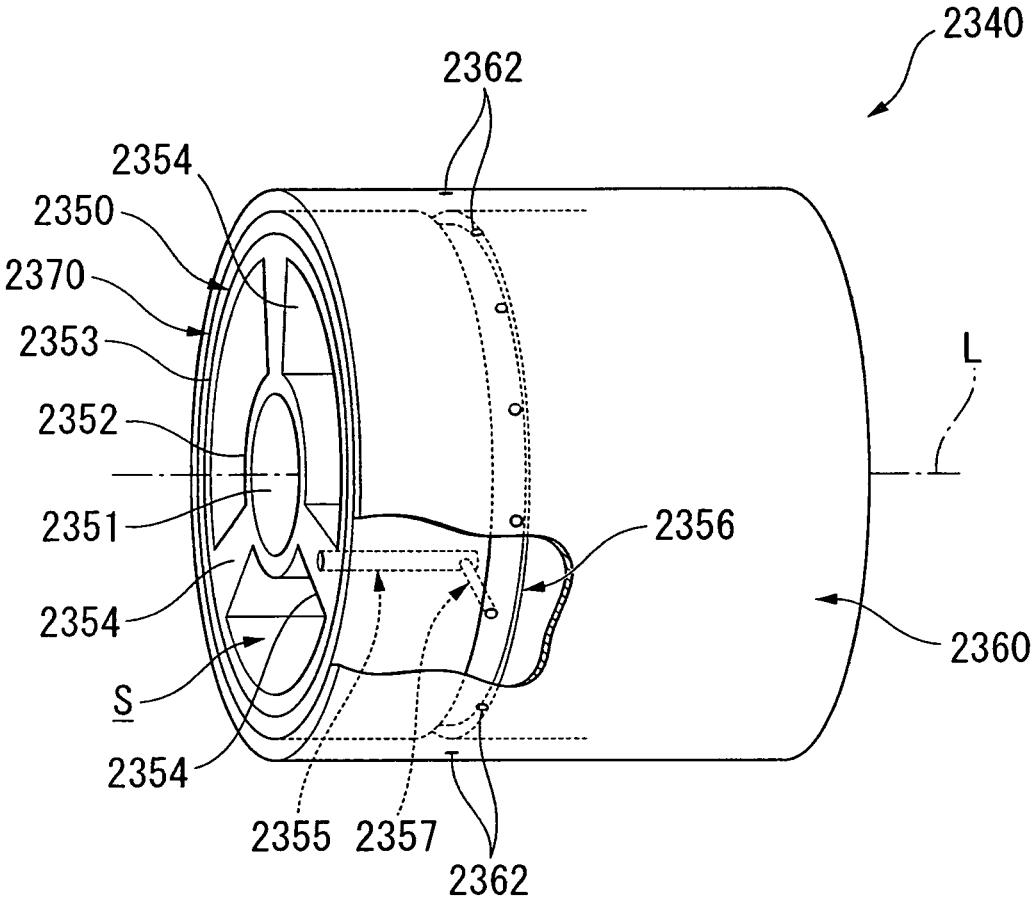
FIG. 28 is a schematic perspective view showing a printing plate cylinder related to an eleventh embodiment of the present invention.

Next, a printing plate cylinder which is an eleventh embodiment of the present invention will be described. As shown in FIG. 28 a printing plate cylinder 2340 which is the present embodiment has a substantially columnar appearance which extends in the direction of an axis L, and includes a core member 2350 which is located on the inner circumferential side, a sleeve member 2360 which forms a cylindrical shape and is coaxially arranged on the outer circumferential side of the core member 2350, and an interlayer 2370 which is formed between the core member 2350 and the sleeve member 2360.

In the present embodiment, the core member 2350 is made of carbon steel, the sleeve member 2360 is made of stainless steel, and the interlayer 2370 is made of a resin material.

The core member 2350, similarly to the eighth embodiment, has an inside tubular portion 2352 which has a fitting hole 2351 which penetrates in the direction of the axis L, an outside tubular portion 2353 arranged at a distance from the outer circumferential surface of the inside tubular portion 2352, and a plurality of (three in the illustrated example) ribs 2354 which extend in the radial direction and connect the inside tubular portion 2352 and the outside tubular portion 2353 integrally.

A resin material which forms the interlayer 2370 is made of, for example, polyetheretherketone resin (so-called PEEK resin), is lightweight, and has a lower heat conductivity compared to carbon steel.

According to the printing plate cylinder 2340 of this configuration, the core member 2350 is made of carbon steel having good workability. Thus, the fitting hole 2351 into which the rotary shaft 2006 of the offset printing apparatus 2000A is fitted can be shaped with high dimensional accuracy, and it is possible to smoothly perform attachment and detachment of the printing plate cylinder 2340. Additionally, since the gap region S is formed, it is possible to reduce the weight of the printing plate cylinder 2340.

Additionally, since the sleeve member 2360 on which the printing plate is mounted is made of stainless steel having excellent corrosion resistance and rigidity, it is possible to suppress generation of rust without performing plating treatment on the cylindrical surface of the sleeve member 2360. Moreover, since the rigidity of the cylindrical surface is improved, printing can be stably performed.

Moreover, since the interlayer 2370 made of a resin material having low heat conductivity is provided between the core member 2350 and the sleeve member 2360, it is possible to suppress conduction of heat generated from a driving unit of the offset printing apparatus 2000A, and stable printing can be performed over a long period of time.

Although the embodiments of the present invention have been described hitherto, the present invention is not limited thereto, and can be appropriately changed departing from the technical idea thereof.

For example, although the printing plate cylinder which mounts the sleeve printing plate has been described in the present embodiment, the present invention is not limited thereto, and a printing plate cylinder which mounts a plate-shaped printing plate may be adopted.

Additionally, although a description has been made in the eleventh embodiment that one interlayer is formed, the present invention is not limited thereto, and two or more interlayers may be formed.

Moreover, although a description has been described that polyetheretherketone resin (so-called PEEK resin) is used as the resin material, the present invention is not limited thereto, and other resin materials may be selected.

Additionally, respective materials for the core member, the sleeve member, and the interlayer are not limited to the embodiments, and can be appropriately selected.

Moreover, the shape (the arrangement, number, and shape of ribs) of the core member is not limited to the present embodiment, and can be appropriately designed.

In addition, the eighth to eleventh embodiments can be made to exist with the first to third embodiments and/or the fourth to seventh embodiments. For example, the core member and sleeve member of the printing plate cylinder which is constructed to mount the sleeve printing plate with an increased diameter by air blown from the air outlet holes through the air supply passage may be made of different materials. Additionally, the core member and sleeve member of the printing plate cylinder which is constructed to mount the sleeve printing plate with an increased diameter by air blown from the air outlet holes through the air supply passage and in which the fins which generate an air stream at a gap between the outer circumferential surface of the shaft portion, and the tubular portion are disposed can be made from different materials.

Hereinafter, the present invention will be specifically described by way of examples. However, the present invention is not limited to these examples.

Example 1

As Example 1, a structure in which the printing plate cylinder 1030 shown in FIG. 16 is attached to the printing apparatus 1050 for a can was prepared. Additionally, the sleeve member was mounted on the outer circumferential surface of the printing plate cylinder 1030, and the printing plate was disposed on the outer circumferential surface of the sleeve member. Then, after printing was performed on the workpiece 1056 at printing speed: 1600 cpm by using the printing apparatus 1050 for a can, and operation was performed continuously for 2 hours, the temperature on the surface of the printing plate was measured by a radiation thermometer.

Example 2

As Example 2, a structure in which the printing plate cylinder 1040 shown in FIG. 18 is attached to the printing apparatus 1050 for a can was prepared. Additionally, the cooling member 1041 was mounted on the end of the printing plate cylinder 1040 on the other side. Measurement was performed under the same conditions as Example 1 other than that.

Example 3

As Example 3, a structure in which the cooling member 1041 is removed from the printing plate cylinder 1040 shown in FIG. 18 was prepared. Then, the printing plate cylinder 1040 was mounted on the printing apparatus 1050 for a can, and printing was performed on the workpiece 1056. Measurement was performed under the same conditions as Example 1 other than that.

Comparative Example

As Comparative Example, a structure in which a well-known chamber type printing plate cylinder is attached to the printing apparatus 1050 for a can was prepared. In detail, this printing plate cylinder has disk-like wall portions at both ends in the direction of a central axis C thereof, respectively, and a region surrounded by the surfaces of the wall portions which faces the inside in the direction of the central axis C, the outer circumferential surface of a shaft portion, and the inner circumferential surface of a tubular portion which forms an air chamber. This air chamber is brought into a sealed state which is intercepted from the ambient air. Measurement was performed under the same conditions as Example 1 other than that.

TABLE 1

| | Temperature of surface of printing plate | | |
|---|---|---|---|
| | Before printing | After printing (2 hours) | Evaluation |
| Example 1 | 29° C. | 35° C. | Excellent |
| Example 2 | 29° C. | 36° C. | Excellent |
| Example 3 | 29° C. | 45° C. | Good (with slight alteration depending on kind of ink) |
| Comparative Example | 29° C. | 52° C. | Bad (with alternation in ink) |

As shown in Table 1, in Examples 1 to 3, the temperature of the surface of the printing plate after printing (2 hours) was suppressed to 45° C. or less, and, it was confirmed that a sufficient cooling effect can be acquired even if printing is performed by the printing plate cylinder with relatively low heat radiation using the sleeve member as in these examples. Particularly, in the configuration where an air stream is caused in the region S from the tip side of the driving shaft 1011 towards the base end side by the fins (ribs) as in Examples 1 and 2, the temperature on the surface of the printing plate after printing was suppressed to 40° C. or less, and striking effects were observed.

On the other hand, in Comparative Example, the temperature on the surface of the printing plate after printing rose to 50° C. or more, alternation of ink was observed, and it was found that printing accuracy was affected.

INDUSTRIAL APPLICABILITY

According to the present invention, the weight of the printing plate cylinder can be reduced, and occurrence of printing unevenness at the time of printing can be prevented. Additionally, formation of dew can be minimized, and deterioration of attachability and detachability of the sleeve printing plate to the printing plate cylinder can also be prevented. Additionally, according to the printing plate cylinder, its cooling member, and the printing apparatus for a can related to the present invention, the printing plate cylinder can be cooled with a simple configuration, the rise of the ink temperature of the printing plate can be suppressed to stabilize ink viscosity, and accuracy of ink spread, color tones or the like, can be secured even at the time of continuous operation. Accordingly, it is possible to improve the accuracy and productivity of printing to cope with various demands of printing flexibly. Moreover, according to the present invention, it is possible to provide the printing plate cylinder and the offset printing apparatus including this printing plate cylinder, capable of satisfying various characteristics which are required according to printing conditions (printing states). From the above, the present invention is very useful industrially.

The invention claimed is:

1. A printing plate cylinder forming a cylindrical shape and detachably mounted with a sleeve printing plate capable of increasing its diameter, the printing plate cylinder comprising a shaft portion rotatable about a central axis, a tubular portion formed cylindrically, arranged coaxially with the shaft portion, arranged at a distance from an outer circumferential surface of the shaft portion, and including an inside tubular portion and an outside tubular portion mounted on an outer circumferential surface of the inside tubular portion, and ribs fixed integrally to the outer circumferential surface of the shaft portion and an inner circumferential surface of the inside tubular portion and connecting the shaft portion and the tubular portion to form a gap region between the outer circumferential surface of the shaft portion and the inner circumferential surface of the tubular portion, wherein the tubular portion is formed with an air outlet hole open to an outer circumferential surface of the tubular portion, and at least one of the ribs has an air supply passage formed in the rib, the air supply passage has a first end opening at an end face of the rib and a second end communicating with the air outlet hole to supply air from the first end to the air outlet hole, and the gap region is opened to the outside at both axial ends of the tubular portion.

2. The printing plate cylinder according to claim 1, wherein the air outlet hole is formed so as to penetrate in the thickness direction of the outside tubular portion, and a plurality of the air outlet holes is arrayed in the circumferential direction of the outside tubular portion, and at least one of the outer circumferential surface of the inside tubular portion and the inner circumferential surface of the outside tubular portion is formed with an air circulation groove which is formed so as to extend in the circumferential direction and communicates with the air supply passage and the plurality of air outlet holes.

3. The printing plate cylinder according to claim 2, wherein the plurality of air outlet holes and the air circulation groove are plurally arranged even in the direction of the central axis.

4. The printing plate cylinder according to claim 3, wherein a plurality of the ribs and a plurality of the air supply passages formed in the ribs are formed so as to shift from each other in the circumferential direction, and the respective air supply passages communicate individually with the plurality of air circulation grooves arrayed in the direction of the central axis.

5. The printing plate cylinder according to claim 1, wherein the inside tubular portion and the outside tubular portion are formed from different materials.

6. The printing plate cylinder according to claim 1, wherein a cooling member attachable to and detachable from the end in the direction of the central axis is provided, and the cooling member includes fins, and rotates integrally with the shaft portion to generate an air stream in the gap region.

7. The printing plate cylinder according to claim 6, wherein a driving shaft which is arranged coaxially with the shaft portion to rotatably support the shaft portion is provided, and the air stream is set so as to flow from the tip side of the driving shaft in the direction of the central axis towards the base end side of the driving shaft.

8. The printing plate cylinder according to claim 1, wherein fins are erected with at least one of the outer circumferential surface of the shaft portion and the inner circumferential surface of the tubular portion as base ends, wherein the fins are disposed to generate an air stream in the gap region due to the rotation.

9. The printing plate cylinder according to claim 8, wherein a driving shaft which is arranged coaxially with the shaft portion to rotatably support the shaft portion is provided, and the air stream is set so as to flow from the tip side of the driving shaft in the direction of the central axis towards the base end side of the driving shaft.

10. The printing plate cylinder according to claim 1, wherein the ribs are fins configured to generate an air stream in the gap region due to the rotation.

11. The printing plate cylinder according to claim 10, wherein a driving shaft which is arranged coaxially with the shaft portion to rotatably support the shaft portion is provided, and the air stream is set so as to flow from the tip side of the driving shaft in the direction of the central axis towards the base end side of the driving shaft.

12. The printing plate cylinder according to claim 1, wherein the printing plate cylinder is a printing plate cylinder having a cylindrical surface extending along an axis and mounted with a printing plate having an image pattern on the cylindrical surface, and the printing plate cylinder includes a core member which has a fitting hole into which a rotary shaft of a printing apparatus is fitted and is integrally shaped the shaft portion, the ribs, and the inside tubular portion, and the outside tubular portion arranged on the outer circumferential side of the core member and having the cylindrical surface, and the core member and outside tubular portion are made of different materials.

13. The printing plate cylinder according to claim 12, wherein one or more interlayers are provided between the core member and the outside tubular portion.

14. The printing plate cylinder according to claim 13, wherein the core member is made of carbon steel, the outside tubular portion is made of stainless steel, and an interlayer made of a resin material is formed between the core member and the outside tubular portion.

15. The printing plate cylinder according to claim 12, wherein the core member is made of carbon steel, and the outside tubular portion.

16. The printing plate cylinder according to claim 12, wherein the core member is made of stainless steel, and the outside tubular portion is made of a resin material.

17. The printing plate cylinder according to claim 12, wherein the core member is made of a resin material, and the outside tubular portion is made of stainless steel.

18. A printing apparatus for a can performing printing on a can using a printing plate cylinder, wherein the printing plate cylinder according to claim 1 is used as the printing plate cylinder.

19. An offset printing apparatus comprising the printing plate cylinder according to claim 1, and a rotary shaft which rotatably supports the printing plate cylinder about the axis.

20. A method for producing a printing plate cylinder according to claim 1, the method comprising hollowing a columnar member used as a material of the shaft portion, the rib, and the inside tubular portion in the direction of the central axis, thereby producing a core member in which the shaft portion, the rib, and the inside tubular portion are integrally shaped, and then mounting the core member in the outside tubular portion.

21. The method for producing a printing plate cylinder according to claim 20, wherein shaping of the shaft portion, the rib, and the inside tubular portion is performed by machining.

22. The printing plate cylinder according to claim 1, wherein the rib is formed in a shape of a plate which is made narrow in a circumferential direction of the shaft portion, and is formed so as to extend from an outer circumferential surface of the shaft portion to an inner circumferential surface of the tubular portion and extended along the axial direction of the shaft portion.

23. The printing plate cylinder according to claim 22, wherein a plurality of ribs is arranged at equal intervals in the circumferential direction of the shaft portion.

* * * * *